US011317199B2

(12) United States Patent
Hrudey et al.

(10) Patent No.: US 11,317,199 B2
(45) Date of Patent: Apr. 26, 2022

(54) VENTED ACOUSTIC TRANSDUCERS, AND RELATED METHODS AND SYSTEMS

(71) Applicant: Apple Inc., Cupertino, CA (US)

(72) Inventors: Peter C. Hrudey, Cupertino, CA (US); Justin D. Crosby, Cupertino, CA (US); Gokhan Hatipoglu, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/880,812

(22) Filed: May 21, 2020

(65) Prior Publication Data

US 2020/0382862 A1 Dec. 3, 2020

Related U.S. Application Data

(60) Provisional application No. 62/853,626, filed on May 28, 2019.

(51) Int. Cl.

| | |
|---|---|
| ***H04R 1/40*** | (2006.01) |
| ***H04R 7/16*** | (2006.01) |
| ***H04R 1/28*** | (2006.01) |

(52) U.S. Cl.

CPC ..... *H04R 1/403* (2013.01); *H04R 1/2846* (2013.01); *H04R 7/16* (2013.01); *H04R 2400/11* (2013.01)

(58) Field of Classification Search

None

See application file for complete search history.

(56) References Cited

U.S. PATENT DOCUMENTS

| | | | |
|---|---|---|---|
| 5,812,496 | A | 9/1998 | Peck |
| 10,587,942 | B1 | 3/2020 | Minervini et al. |
| 2002/0181725 | A1 | 12/2002 | Johannsen |

(Continued)

FOREIGN PATENT DOCUMENTS

| | | |
|---|---|---|
| CN | 201134931 | 10/2008 |
| CN | 101321412 | 12/2008 |

(Continued)

OTHER PUBLICATIONS

Non-Final Office Action in U.S. Appl. No. 16/125,532, dated Jun. 8, 2020, 8 pages.

(Continued)

*Primary Examiner* — Walter F Briney, III

(74) *Attorney, Agent, or Firm* — Morgan, Lewis & Bockius LLP

(57) ABSTRACT

An electronic device has an acoustic transducer with an acoustic diaphragm. The diaphragm has opposed first and second major surfaces. A front volume is positioned adjacent the first major surface. A back volume is positioned adjacent the second major surface. An elongated channel defines a barometric vent and extends from a first end fluidly coupled with the front volume to a second end fluidly coupled with the back volume, fluidly coupling the front volume with the back volume. The elongated channel may have a high aspect ratio (L/D), providing the vent with a substantial air mass. The elongated channel may be segmented to define a higher-order filter. For example, a segmented channel can have a cascade of repeating acoustic-mass and acoustic-compliance units, providing the barometric vent with additional degrees-of-freedom for tuning.

28 Claims, 16 Drawing Sheets

(56) References Cited

U.S. PATENT DOCUMENTS

| | | | | |
|---|---|---|---|---|
| 2005/0254673 | A1 | 11/2005 | Hsieh et al. | |
| 2013/0044906 | A1 | 2/2013 | Lee et al. | |
| 2014/0270271 | A1 | 9/2014 | Dehe et al. | |
| 2014/0299949 | A1 | 10/2014 | Conti et al. | |
| 2015/0010191 | A1 | 1/2015 | Baumhauer, Jr. et al. | |
| 2015/0146906 | A1 | 5/2015 | Je et al. | |
| 2015/0245146 | A1 | 8/2015 | Liu | |
| 2015/0289045 | A1 | 10/2015 | Khenkin et al. | |
| 2016/0112807 | A1 | 4/2016 | Yuan et al. | |
| 2016/0150326 | A1 | 5/2016 | Yoo et al. | |
| 2017/0048625 | A1 | 2/2017 | Salmon | |
| 2017/0150248 | A1* | 5/2017 | Littrell | H04R 1/083 |
| 2017/0164084 | A1* | 6/2017 | Vitt | H04R 1/08 |
| 2018/0063634 | A1 | 3/2018 | Dave et al. | |
| 2019/0077654 | A1 | 3/2019 | Reagan et al. | |
| 2019/0084828 | A1 | 3/2019 | Albers et al. | |
| 2019/0306633 | A1* | 10/2019 | Yang | H04R 19/04 |
| 2020/0039816 | A1 | 2/2020 | Zou | |
| 2020/0053458 | A1 | 2/2020 | Ring et al. | |
| 2020/0071157 | A1* | 3/2020 | Yang | B81B 7/0061 |
| 2020/0255284 | A1* | 8/2020 | Kueffner | H04R 31/00 |

FOREIGN PATENT DOCUMENTS

| | | | |
|---|---|---|---|
| CN | 201438742 | 4/2010 | |
| CN | 102625992 | 8/2012 | |
| CN | 103404167 | 11/2013 | |
| CN | 107079207 | 8/2017 | |
| EP | 3072406 A1 * | 9/2016 | H04R 1/028 |

OTHER PUBLICATIONS

Chinese Office Action from Chinese Patent Application No. 202010458416.3, dated May 20, 2021, 20 pages including English language translation.

Chinese Notification to Grant Patent from Chinese Patent Application No. 202010458416.3, dated Dec. 14, 2021, 8 pages including English language translation.

* cited by examiner

VENTED ACOUSTIC TRANSDUCERS, AND RELATED METHODS AND SYSTEMS

CROSS-REFERENCE TO RELATED APPLICATIONS

This application claims priority from and benefit of U.S. Patent Application No. 62/853,626, filed May 28, 2019, the contents of which are hereby incorporated in their entirety for all purposes.

FIELD

This application and the subject matter disclosed herein (collectively referred to as the "disclosure"), generally concern vented acoustic transducers, and related methods and systems. More particularly, but not exclusively, vent arrangements configured to exhibit a complex acoustic impedance are described in relation to a variety of electro-acoustic transducers and electronic devices incorporating such transducers. Examples of electro-acoustic transducers include loudspeaker transducers, and microphone transducers, including by way of example, MEMs microphone transducers.

BACKGROUND INFORMATION

In general, sound (sometimes also referred to as an "acoustic signal") constitutes a vibration that propagates through a carrier medium, such as, for example, a gas, a liquid, or a solid. An electro-acoustic transducer, in turn, is a device configured to convert incoming sound to an electrical signal, or vice-versa.

Over the course of its useful life, an electro-acoustic transducer may be exposed to a variety of ambient pressures, e.g., barometric pressures. For example, an electronic device having an electro-acoustic transducer may be operated by a user at different elevations (e.g., from around sea level to high alpine environments) or even under water (e.g., when participating in a water sport, like swimming, surfing, rafting, wake boarding, etc.). Such variation in ambient pressure can induce movement of the transducer's diaphragm, affecting an output of the transducer. And, above a given threshold or rate of change, such movement can even damage the transducer.

More specifically, a large pressure gradient applied across a conventional acoustic diaphragm can bias the diaphragm to an outermost (or innermost) position of displacement. When biased by an external load, operation of the acoustic transducer, whether configured as a loudspeaker or a microphone, can be negatively affected, or the transducer can be altogether rendered inoperable. Examples of negative effects include acoustic distortion or lower-than-normal amplitude (e.g., emitted or detected loudness).

SUMMARY

Disclosed acoustic transducers include a diaphragm and a vent to equalize pressure across the diaphragm. More particularly, but not exclusively, certain disclosed venting arrangements permit equalization of barometric pressures (e.g., low-frequency variation or slow rate-of-change in pressure) across the diaphragm, while inhibiting pressure equalization under higher-frequency variations in pressure (e.g., in an audible bandwidth).

Disclosed vents define a passageway having a complex acoustic impedance. Some passageways with a complex acoustic impedance have a high aspect ratio (e.g., a length-to-effective-diameter ratio between about 1,000 and about 32,000, or a ratio of length-to-cross-sectional-area between about $1\times10^8$ and about $2\times10^9$), providing the passageway with a large acoustic mass and causing the vent to behave as an acoustic inductor. Other of passageways having a complex acoustic impedance described in detail below are segmented, defining a plurality of acoustic-mass units juxtaposed with a corresponding plurality of acoustic-compliance units. As described more fully below, an acoustic-mass unit can be arranged as a comparatively narrow duct, and an acoustic-compliance unit can be arranged as a comparatively larger duct, or chamber.

Disclosed vents can substantially reduce so-called "leak noise" or "leakage noise." Leakage noise can arise, generally, when the diaphragm is excited by a flow of air (or other acoustic medium) through a vent, particularly when the flow excites the diaphragm within a desired bandwidth (e.g., a human-audible band). Such leakage noise may arise, for example, when a vent behaves primarily as an acoustic resistor. In contrast to a resistive vent, a vent as described herein can damp flow through the vent when exposed to pressure variations (or sound) in a desired frequency band (e.g., between about 20 Hz and about 20 kHz), and yet can permit flow under low-frequency or slow variations in pressure (e.g., as with changes barometric pressure).

Consequently, disclosed venting arrangements can reduce leak noise, a significant contributor to in-band noise power, while still providing a passage to equalize pressures across a diaphragm. Thus, transducers incorporating disclosed venting arrangements can provide improved signal-to-noise signals compared to transducers incorporating a predominantly resistive venting arrangement.

Further, by equalizing pressures across the diaphragm, disclosed venting arrangements can reduce or eliminate external biasing forces applied to the diaphragm by changes in ambient pressures. Moreover, reduced biasing forces can permit the transducer to provide lower acoustic distortion and can allow the diaphragm to move through full-stroke excursions over a wide range of ambient pressures. Thus, acoustic transducers incorporating disclosed venting arrangements can provide improved emitted or detected loudness over a wide range of ambient pressures.

In accordance with an aspect, an electronic device has an acoustic transducer element having an acoustic diaphragm. The diaphragm has opposed first and second major surfaces. A front volume is positioned adjacent the first major surface of the diaphragm, and a back volume is positioned adjacent the second major surface of the diaphragm. An "elongated channel" defines a barometric vent fluidly coupling the front volume with the back volume. The elongated channel extends from a first end fluidly coupled with the front volume to a second end fluidly coupled with the back volume. According to an aspect, the elongated channel can be a "segmented channel" that is segmented into a plurality of acoustic-mass units juxtaposed with a corresponding plurality of acoustic-compliance units. In another aspect, the elongated channel circuitously extends from the first end to the second end.

The barometric vent can be configured to equalize pressure between the front volume and the back volume. Some disclosed electro-acoustic devices also include a substrate coupled with the acoustic transducer element. The substrate can define an acoustic port opening to the front volume. In an aspect, the substrate further defines the barometric vent.

In some aspects, the substrate is a first substrate, and the electro-acoustic device can include a second substrate. For example, the first substrate can be mounted to the second substrate. The electro-acoustic device can further include an integrated circuit device mounted to the second substrate. The integrated circuit device and the acoustic transducer element can be electrically coupled with each other. The second substrate can include an electrical output connection coupled with the integrated circuit device. The electro-acoustic device can also have a recessed lid overlying the acoustic transducer element, the first substrate, and the integrated circuit device.

The barometric vent can open to the acoustic port, the front volume, or both.

A disclosed substrate can include a plurality of juxtaposed layers. An aperture can extend through the plurality of layers to define the acoustic port. At least one of the layers can define a corresponding segment of a sinuous passage. The sinuous passage can fluidly couple the front volume with the back volume, defining the elongated channel. The sinuous passage can include at least one convolution.

A first layer of a disclosed substrate can define a corresponding first segment of the sinuous passage and the second layer can define a corresponding second segment of the sinuous passage. The substrate can also include an intermediate layer of material separating the first layer and the second layer from each other. The intermediate layer can define an aperture fluidly coupling the first segment of the sinuous passage with the second segment of the sinuous passage, defining a convolution in the sinuous passage.

As noted above, a disclosed substrate can have a first layer and a second layer. The second layer can be positioned between the first layer and the acoustic diaphragm. The second layer can include a sacrificial insulator susceptible to etching. The second layer can also include an etch-stop defining a boundary of a recess that extends through the sacrificial insulator. The recess can define a corresponding portion of the elongated channel.

In an aspect, the elongated channel can extend from a position adjacent the acoustic port, the front volume, or both, to a position adjacent the back volume.

The substrate can define a tortuous segment of the barometric vent. The tortuous segment can open to the front volume. The acoustic transducer element can be mountably coupled with the substrate and can define an aperture aligned with the tortuous segment of the barometric vent. The aperture can open to the back volume, fluidly coupling the barometric vent (and thus the front volume) with the back volume through the acoustic transducer element.

A disclosed acoustic transducer element can include a back plate and an insulator positioned between the diaphragm and the backplate.

A disclosed acoustic transducer element can include a first back plate and a corresponding first insulator positioned between the first back plate and the diaphragm. The acoustic transducer element can also include a second back plate and a corresponding second insulator positioned between the second back plate and the diaphragm. The diaphragm can be positioned between the first back plate and the second back plate.

A disclosed acoustic transducer element can include a first diaphragm and a second diaphragm. The acoustic transducer element can also include a back plate, a first insulator positioned between the back plate and the first diaphragm, and a second insulator positioned between the second diaphragm and the back plate. For example, the back plate can be positioned between the first diaphragm and the second diaphragm.

A disclosed diaphragm can include a piezoelectric actuator. An acoustic transducer element can include a first substrate defining a corresponding open port. The piezoelectric actuator can be mounted to the first substrate and extend over the open port of the first substrate. The acoustic transducer element can be mounted to a second substrate defining a corresponding acoustic port with the open port aligned with the acoustic port, and the piezoelectric actuator extending across the aligned open port and acoustic port, defining a boundary therebetween.

In accordance with another aspect, an electronic device includes an acoustic transducer element having a movable diaphragm. The diaphragm has opposed first and second major surfaces, and the acoustic transducer element defines an aperture positioned adjacent the movable diaphragm. A substrate couples with the acoustic transducer element. The substrate defines an acoustic port open to the acoustic transducer element. An elongated passageway extends from a first end fluidly coupled with the acoustic port to a second end fluidly coupled with the aperture, defining a barometric vent coupling the acoustic port with the aperture.

The substrate can include a plurality of juxtaposed layers and an opening can extend through the plurality of layers to define the acoustic port. At least one of the layers can define a corresponding channel defining a segment of the passageway. The passageway can include a tortuous passageway having at least one convolution.

The at least one of the layers can include a first layer and a second layer. The first layer can define a corresponding first channel and the second layer can define a corresponding second channel. The first channel and the second channel can be fluidly coupled with each other, defining a convolution in the elongated passageway.

The plurality of juxtaposed layers can include a first layer and a second layer. The second layer can be positioned between the first layer and the acoustic transducer element. The second layer can include a sacrificial insulator susceptible to etching and an etch-stop defining a boundary of a channel extending through the sacrificial insulator. The channel can define a corresponding portion of the elongated passageway.

The acoustic transducer element can include a back plate and an insulator positioned between the diaphragm and the backplate.

The acoustic transducer element can include a first back plate and a corresponding first insulator positioned between the first back plate and the diaphragm. The acoustic transducer element can include a second back plate and a corresponding second insulator positioned between the second back plate and the diaphragm. The diaphragm can be positioned between the first back plate and the second back plate.

The diaphragm of the acoustic transducer element can be a first diaphragm. The acoustic transducer element can also include a back plate and a first insulator positioned between the back plate and the first diaphragm. The acoustic transducer element can also include a second diaphragm and a second insulator positioned between the second diaphragm and the back plate. The back plate can be positioned between the first diaphragm and the second diaphragm.

The diaphragm of the acoustic transducer element can include a piezoelectric actuator. The diaphragm can be mounted to the substrate and the piezoelectric actuator can extend over the acoustic port.

Also disclosed are associated computing environments that can incorporate described technologies.

The foregoing and other features and advantages will become more apparent from the following detailed description, which proceeds with reference to the accompanying drawings.

BRIEF DESCRIPTION OF THE DRAWINGS

Referring to the drawings, wherein like numerals refer to like parts throughout the several views and this specification, aspects of presently disclosed principles are illustrated by way of example, and not by way of limitation.

FIG. 2 is annotated with an electrical analog of an acoustic pathway through the package.

FIG. 4 is annotated with an electrical analog of an acoustic pathway through the package.

DETAILED DESCRIPTION

Figure 1:
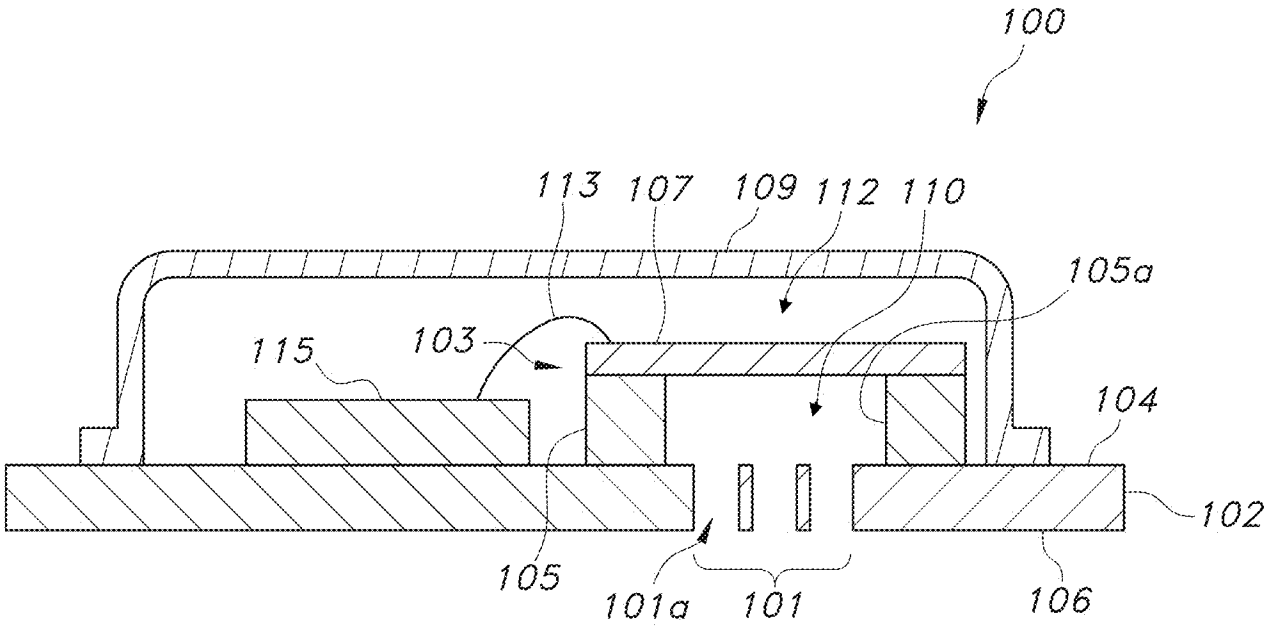
FIG. 1 illustrates a cross-sectional view taken through a package for an acoustic transducer, e.g., a MEMS microphone transducer.

The following describes various principles concerning vented acoustic transducers and transducer packages, and related methods and systems, by way of reference to specific features. For example, certain principles pertain to barometric vents for transducer elements, and other principles pertain to barometric vents for transducer packages. More particularly but not exclusively, certain aspects pertain to vents that have complex acoustic impedance to equalize barometric pressure across acoustic diaphragms. Vents described in context of specific configurations are just particular examples of contemplated vent arrangements chosen as being convenient illustrative examples of disclosed principles. Nonetheless, one or more of the disclosed principles can be incorporated in various other arrangements of acoustic transducers, modules, and systems to achieve any of a variety of corresponding system characteristics.

Thus, vented acoustic transducers, modules, and systems (and associated techniques) having attributes that are different from those specific examples discussed herein can embody one or more presently disclosed principles, and can be used in applications not described herein in detail. Accordingly, such alternative embodiments can also fall within the scope of this disclosure.

I. Overview

A loudspeaker can emit an acoustic signal in a carrier medium by vibrating or moving an acoustic diaphragm to induce, or otherwise inducing, a pressure variation or other vibration in the carrier medium. For example, an electromagnetic loudspeaker arranged as a direct radiator can induce a time-varying magnetic flux in a coil (e.g., a wire wrapped around a bobbin) attached to a diaphragm. The coil can be exposed to a magnetic field, e.g., a magnetic field of a permanent magnet, and a resultant force as between the magnetic flux emanated from the coil and the magnetic field(s) can urge the coil, and thus the diaphragm, into motion.

Conversely, a microphone transducer can be configured to convert an incoming acoustic signal to, for example, an electrical signal. An acoustic diaphragm of a microphone transducer, e.g., a MEMs microphone transducer, can vibrate, move, or otherwise respond to a pressure variation received through a surrounding or adjacent carrier medium. Movement of the diaphragm can induce a corresponding response in an electrical component. For example, movement of a diaphragm in a capacitive MEMs microphone can alter a capacitance of the device, inducing an observable, time-varying voltage signal in an electrical circuit. As another example, movement of a piezoelectric diaphragm can generate a time-varying electrical signal by virtue of a piezoelectric response to the movement. A time-varying electrical response generated with either type of microphone transducer can be converted to a machine-readable form (e.g., digitized) for subsequent processing.

Thus, an electro-acoustic transducer (sometimes simply referred to as an "acoustic transducer") in the form of a loudspeaker can convert an incoming signal (e.g., an electrical signal) to sound, while an acoustic transducer in the form of a microphone can convert incoming sound to an electrical (or other) signal. As used herein, the term "audio signal" can refer to an electrical response (e.g., an analog or a digital signal) carrying audio information or data that can be converted to sound or that has been converted from sound.

An acoustic transducer can be mounted to a substrate (or chassis) and covered or enclosed by a housing (or lid) to define an enclosed acoustic chamber partially bounded by the diaphragm. With such an arrangement, the diaphragm can induce an acoustic response in the chamber as the diaphragm emits or receives sound energy.

Figure 2:
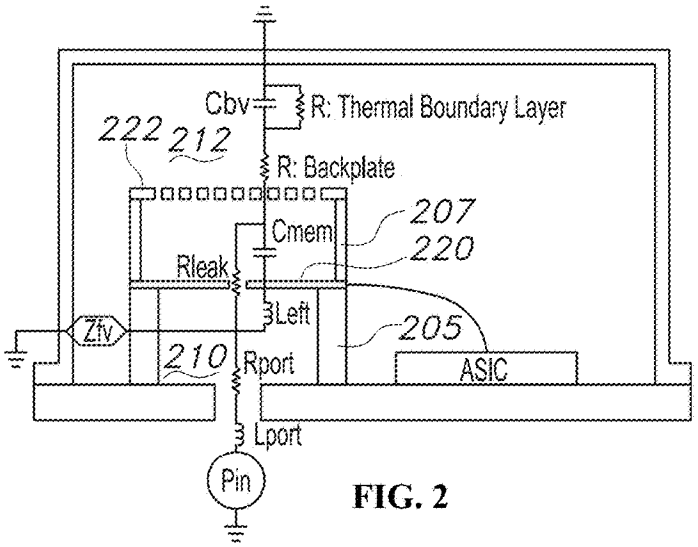
FIG. 2 schematically illustrates a cross-sectional view taken through a package for an acoustic transducer having an acoustically resistive barometric vent.
Figure 3:
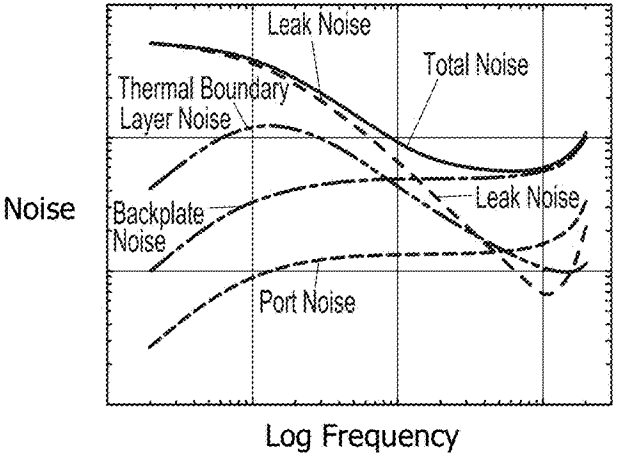
FIG. 3 shows a plot comparing contribution of several noise sources to total acoustic noise for a packaged transducer as in FIG. 2.
Figure 4:
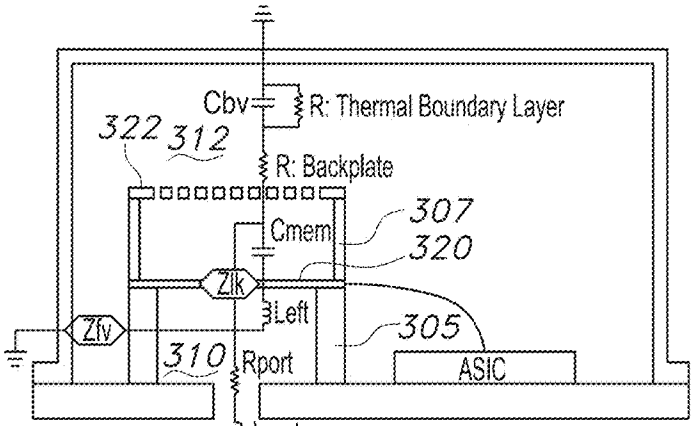
FIG. 4 schematically illustrates a cross-sectional view taken through a package for an acoustic transducer having a barometric vent that exhibits a complex acoustic impedance.

Referring now to FIGS. 1, 2 and 4, component packages, e.g., for microphone transducers, are illustrated and briefly described. In FIG. 1, the component package 100 has a substrate 102 defining a first major surface 104 and an opposed second major surface 106. The substrate 102 also defines at least one aperture 101*a* extending through the substrate from the first major surface 104 to the second major surface 106, defining a sound-entry opening 101 (sometimes also referred to as an acoustic port) through the substrate 102. A microphone transducer 103 is mountably coupled with the substrate 102 on the first major surface 104 and has a sound-responsive diaphragm (e.g., as in FIGS. 2 and 4) acoustically coupled with the sound-entry opening 101 defined by the substrate, permitting sound to enter a front volume bounded in part by the microphone transducer. A lid 109, mounted to the substrate 102, overlies the microphone transducer 103 and defines a back volume 112.

A pressure gradient between the front volume 110 and the back volume 112 can apply a biasing force to the diaphragm. Some disclosed electro-acoustic devices 103 and transducer elements 107 are barometrically vented, e.g., to equalize barometric pressure on opposed sides of the diaphragm. As an alternative, some transducer packages 100 are barometrically vented, e.g., to equalize barometric pressure on opposed sides of the diaphragm.

Such vented transducers and packages can mitigate or eliminate movement of the diaphragm arising from variations in ambient pressure, and thus can mitigate or eliminate effects of changes in ambient pressure on transducer output. Moreover, vented transducers and packages can mitigate or eliminate a likelihood of damage to the transducer by virtue of changes in ambient pressure.

In some respects, concepts disclosed herein generally concern vented acoustic transducers and related methods and systems. Some disclosed concepts pertain to components configured to equalize a static or a low-frequency pressure differential across an acoustic diaphragm. As an example, some disclosed transducers and packages have a vent arrangement configured to exhibit a complex acoustic impedance. Some vents incorporate an elongated, tortuous passage fluidly coupling a front volume of a transducer with a back volume of the transducer, providing a compact arrangement for a vent having complex acoustic impedance that may be quite long compared to the vent's cross-section or even the transducer's or package's overall dimensions. Other vents incorporate a segmented passage having a plurality of acoustic-mass-units juxtaposed with a corresponding plurality of acoustic-compliance-units, providing a higher-order filter.

Referring again to FIG. 1, a microphone transducer 103 can have a sound-responsive element 107, sometimes also referred to as an "acoustic transducer element." The illustrated transducer 105 also includes a substrate 105 supporting the acoustic transducer element, e.g., on which the acoustic transducer element is formed during manufacture. The substrate 105 defines a sound-entry opening 105*a* that permits sound waves to enter the acoustic-transducer element, e.g., from the sound entry opening 101 of the package substrate 102.

Many configurations of acoustic transducer elements are possible, several of which are described below by way of example. For example, the microphone transducer 103 may include, for example, a micro-electro-mechanical system (MEMS) microphone. A flexible diaphragm spaced apart from a capacitive back plate provides one arrangement of an acoustic transducer element for a MEMS microphone, as described more fully below. It is contemplated, however, that microphone transducer can be any type of electro-acoustic transducer operable to convert sound into an electrical output signal, such as, for example, a piezoelectric microphone, a dynamic microphone or an electret microphone.

In the schematic illustrations of MEMS microphones in FIGS. 2 and 4, each sound-responsive element 207, 307 includes a corresponding diaphragm 220, 320 and a backplate 222, 322 mountably coupled with a substrate 205, 305. Each diaphragm is spaced apart from the corresponding backplate by a spacer, defining a respective gap positioned between the diaphragm and the backplate. In FIGS. 2 and 4, each respective acoustic diaphragm 220, 320 can define a boundary between a front volume 210, 310 and a back volume 212, 312. As sound enters a front volume, corresponding pressure gradients form between the front volume 210, 310 and the back volume 212, 312, perturbing the respective diaphragm 220, 320. As a diaphragm moves relative to the corresponding back plate due to sound, capacitance of the acoustic transducer element changes in correspondence with sound pressure level. The variations in capacitance can be observed to generate an electrical signal corresponding to variations in sound pressure level. That electrical signal or one derived from it (e.g., after processing to digitize, or to remove noise or echo) is sometimes referred to in the art as an audio signal.

As noted above, the front volume 210, 310 and the corresponding back volume 212, 312 can be fluidly coupled with each other, e.g., to equalize pressure between the back volume and the front volume. For example, the diaphragm 220 can be perforated, as depicted schematically in FIG. 2. Such a perforation can define an acoustically resistive vent fluidly coupling the front volume with the back volume. Nonetheless, an acoustically resistive vent can give rise to a substantial level of so-called "leak noise," as when the diaphragm is excited by a flow of air through the vent driven by pressure variations having a frequency within a desired frequency band (e.g., human-audible band).

Figure 5:
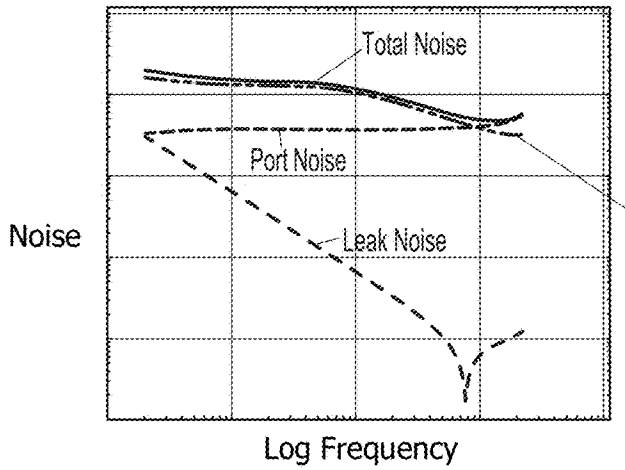
FIG. 5 shows a plot comparing contribution of several noise sources to total acoustic noise for a packaged transducer as in FIG. 4.

As an alternative, shown schematically for example in FIG. 4, a vent with a complex acoustic impedance can substantially reduce leakage noise (FIG. 5). In contrast to a resistive vent, a vent with complex acoustic impedance can damp flow through the vent when exposed to pressure variations (or sound) in the desired frequency band, and yet can permit flow under low-frequency variations in pressure (e.g., as with changes barometric pressure). Although FIG. 4 schematically illustrates a vent with a complex acoustic impedance across the diaphragm 320, FIG. 4 should not necessarily be interpreted as requiring the vent to extend through the diaphragm, though that may be an option in some arrangements.

In other arrangements, a vent with complex acoustic impedance can extend through structure adjacent the diaphragm rather than the diaphragm itself, fluidly coupling the front volume 310 with the back volume 312. For example, an elongated channel can extend from the front volume 310 to the back volume 312, fluidly coupling them together and defining a vent with a complex acoustic impedance. An elongated channel as disclosed herein can provide sufficient air mass to impede airflow through the vent when exposed to pressure variations above a threshold frequency. In some aspects, the elongated channel can be defined by a high-aspect-ratio passageway, and in other aspects, the elongated channel can be segmented to provide a higher-order filter.

Nonetheless, providing a high-aspect-ratio vent in a confined volume, e.g., in an electro-acoustic transducer or other electronic device, presents certain difficulties and is not straightforward. For example, a length of such a vent may be several orders of magnitude larger than an acoustic-transducer device's nominal dimensions or several orders of magnitude larger than an acoustic-transducer package's nominal dimensions.

Figure 6:
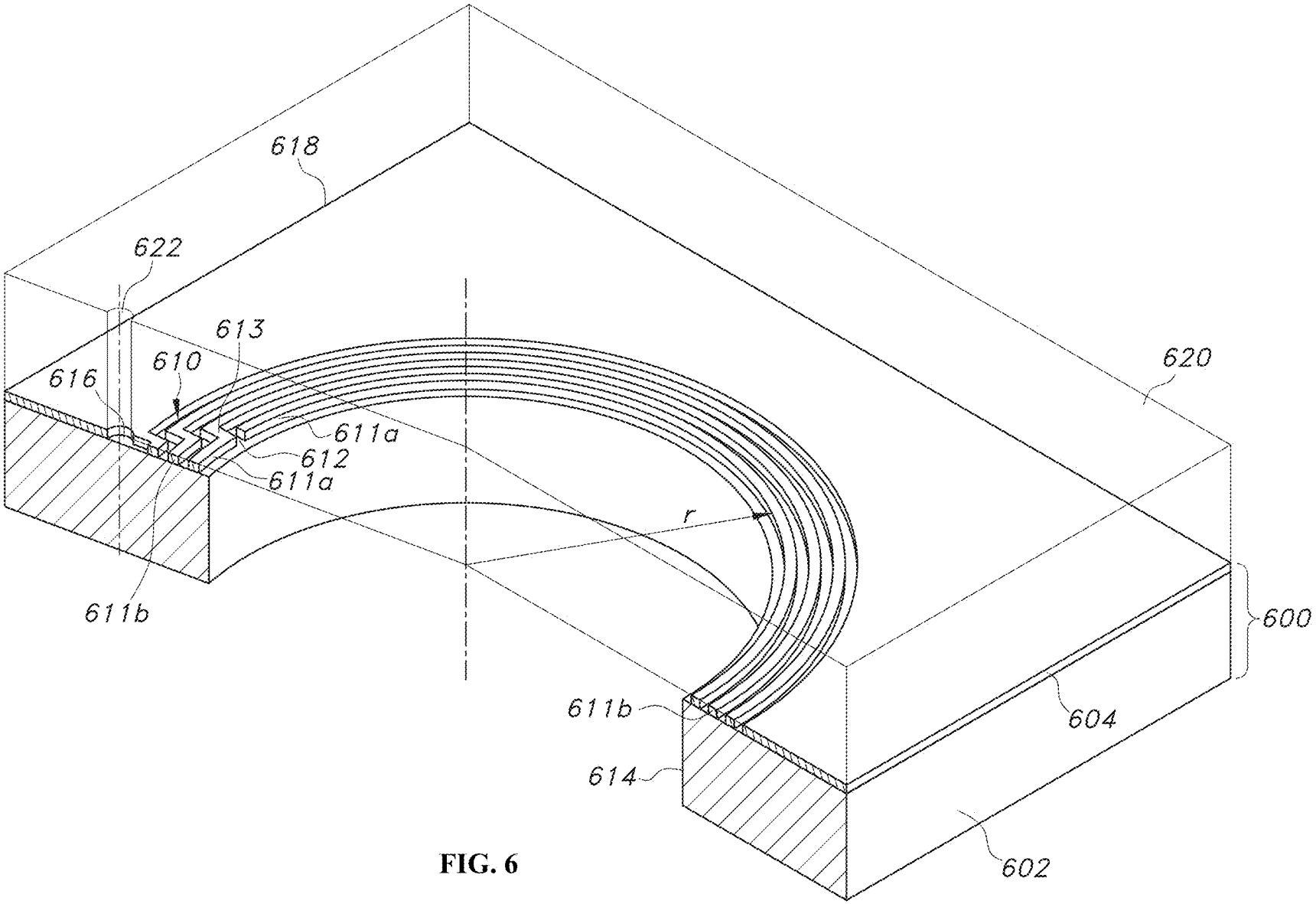
FIG. 6 illustrates an isometric view of a substrate defining a high-aspect-ratio barometric vent, sectioned along line A-A in FIG. 7.

As shown in FIG. 6, however, a tortuous channel 610 can define a high-aspect-ratio barometric vent suitable to be incorporated in a transducer component 103 (e.g., within the substrate 105) or a transducer package 100 (e.g., within the substrate 102). Alternatively, a plurality of mass and compliance units as in FIGS. 17A through 17C can be assembled together to define a segmented channel that provides a higher-order roll-off than the tortuous channel 610. With disclosed vents having complex acoustic impedance, low-frequency pressure variations, such as for example, due to weather changes, changes in a user's elevation, or pressurization of a passenger cabin on an airplane, can be equalized between the front volume 110 and the back volume 112. Such a vent can significantly reduce noise in an audible frequency band arising by virtue of leakage through the barometric vent.

Further details of disclosed principles are set forth below. Section II describes principles pertaining generally to microphone packages. Section III describes principles pertaining to substrates that define tortuous channels suitable to provide a barometric vent with complex acoustic impedance. Section IV describes principles pertaining to vented microphone transducers and vented packages for microphone transducers. Section V describes several attributes of improved performance attainable by incorporating disclosed venting arrangements. And, Section VI describes principles related to a general purpose computing environment that can implement disclosed technologies.

As used herein, the terms "sinuous," "tortuous," "circuitous," and "serpentine" are used synonymously and intended to connote structure that may be, but is not necessarily, curved, straight, ordered, disordered, spiraled, or laced or intertwined with, within, or through other structure.

II. Microphone Packages

Referring again to FIG. 1, the microphone transducer 103 can be mounted on or otherwise be operatively coupled with another substrate 102, e.g., a package-level substrate and/or an interconnect substrate. The microphone package 100 can also include a lid 109 overlying the acoustic transducer 103. The lid 109 can be recessed, defining a chamber, or back volume 112, for the transducer 103.

In FIG. 1, the package substrate 102 defines a sound entry region 101 acoustically coupled with the sound-entry opening 105*a* defined by the substrate 105 of the microphone package 103. The sound-entry region 101 may be a single aperture or may be defined by a plurality of apertures 101*a* defining a perforated region of the substrate 102. In either arrangement, the sound entry region 101 is acoustically, and in many instances fluidly, coupled with the sensitive region of the sound-responsive element 107 of the microphone transducer 103. An unoccupied, open chamber bounded by the substrate 102, the substrate 105, and the sensitive region of the microphone transducer 103 is sometimes referred to in the art as a "front volume."

The acoustic port 105*a* through the microphone substrate 105 can be the same size and shape as the sound-entry region 101 of the microphone package 100, or the acoustic port 105*a* 150 can be larger or smaller, or otherwise shaped differently, than the sound-entry region 101.

A typical package level substrate 102 can have a thickness measuring between about 0.250 mm and about 0.65 mm, e.g., between about 0.300 mm and about 0.600, or between about 0.400 mm and about 0.500 mm. That typical substrate 102, when viewed from above as in FIG. 7 (e.g., in a plane orthogonal to the direction of "thickness"), can have an ordinate dimension measure about 4.000 mm by about 3.500 mm. For example, in selected aspects, each in-plane ordinate dimension can measure between about 2.500 mm and about 6.000 mm, such as, for example, between about 3.000 mm and about 5.000, or between about 3.300 mm and about 4.100 mm.

Each aperture 101*a* defining a sound-entry region 101 through the substrate 102 can be a non-plated through via having a diameter measuring between about 50 μm and about 200 μm, such as, for example, between about 75 μm and about 150 μm, e.g., between about 90 μm and about 110 μm. The sound-entry region 101 can have a characteristic dimension, e.g., a hydraulic diameter in selected aspects, measuring between about 1.000 mm and about 3.000 mm, such as, for example, between about 1.200 mm and about 2.400 mm, e.g., between about 1.4 mm and about 2.2 mm. Naturally, other configurations and dimensions for a sound-entry region 101 are possible. The dimensions listed above have been chosen as being representative of one particular configuration of the many configurations contemplated by this disclosure.

The sound-entry region 101, and each respective aperture 101*a*, has a corresponding characteristic dimension. Flow or acoustic characteristics of an aperture may vary with a selected characteristic dimension of the aperture. In some instances, a characteristic dimension of a given structure can be defined in a manner to enable, e.g., acoustic or flow comparisons of structures having different shapes. For example, a characteristic dimension of a circle can be a diameter of the circle. On the other hand, a characteristic dimension of a square can be length of the side of the square, or a ratio of an area of the square to a perimeter of the square. Such a ratio is sometimes referred to in the art as a hydraulic diameter. For a circle, the ratio reduces to the diameter of the circle.

Referring still to FIG. 1, the microphone package has an integrated circuit device 115 (e.g., an application-specific integrated circuit, or ASIC) mounted to the package substrate 102. A bond wire 113 electrically couples the integrated circuit device with the acoustic transducer element 107. For a capacitive MEMS microphone, the ASIC 115 can include circuitry to impose a charge on the acoustic transducer element 107, and as the diaphragm (not shown in FIG. 1) deforms, the ASIC can observe changes in voltage arising from the deformation of the diaphragm (e.g., changes in capacitance). The voltage variations can correspond to sound waves that induce the deflections in the diaphragm.

The package substrate 102 can have an electrical output connection (not shown) coupled with the integrated circuit device 115. As well, the package substrate 102 can have an electrical trace or other electrical coupler that extends from the contact to another region defined by the substrate (e.g., a second, external electrical contact). Consequently, the package substrate 102 can electrically couple an external portion of an electrical circuit with the ASIC 115.

The package 100 can be mounted to and electrically coupled with an interconnect substrate (not shown). In general, an interconnect substrate can include a plurality of electrical conductors configured to convey an electrical signal, or a power or a ground signal, from one interconnection location (e.g., a solder pad) to another interconnection location (e.g., another solder pad). For example, a packaged component, e.g., the packaged microphone transducer 100 can be soldered or otherwise electrically coupled with one or more interconnection locations defined by an interconnect substrate.

The interconnect substrate can electrically couple the packaged component 100 with one or more other components (e.g., a memory device, a processing unit, a power supply) physically separate from the packaged component. In addition to the microphone transducer, one or more other components can electrically couple with the electrical conductors in the interconnect substrate, electrically coupling the microphone package with such other component. Examples of the other component can include a processing unit, a sensor of various types, and/or other functional and/or computational units of a computing environment or other electronic device.

In an aspect, the interconnect substrate (not shown) can be a laminated substrate having one or more layers of electrical conductors juxtaposed with alternating layers of dielectric or electrically insulative material, e.g., FR4 or a polyimide substrate. Some interconnect substrates are flexible, e.g., pliable or bendable within certain limits without damage to the electrical conductors or delamination of the juxtaposed layers. The electrical conductors of a flexible circuit board may be formed of an alloy of copper, and the intervening layers separating conductive layers may be formed, for example, from polyimide or another suitable material. Such a flexible circuit board is sometimes referred to in the art as "flex circuit" or "flex." As well, the flex can be perforated or otherwise define one or more through-hole apertures.

Although not illustrated, the microphone package 100 can define a plurality of exposed electrical contacts configured to be soldered or otherwise electrically connected with a corresponding interconnection location defined by the interconnect substrate. In an aspect, the electrical contacts are exposed on a same side of the transducer package 100 as the sound-entry region 101 (e.g., the bottom side 106). The interconnect substrate can define an aperture or other gas-permeable region (not shown) configured to permit an acoustic signal to pass therethrough in an acoustically transparent manner, or with a selected measure of damping, acoustically coupling an ambient environment with the sensitive region of the microphone transducer 103 through the interconnect substrate. In an alternative arrangement, the electrical contacts are exposed on the top side 104 of the substrate 102.

III. Substrates with Tortuous, Sinuous or Serpentine Channels

FIG. 6 schematically illustrates a high-aspect ratio channel 610 defined by a substrate 600. The substrate 600 in FIG. 6 can be representative of either substrate shown in FIG. 1, e.g., a transducer substrate 105 or a package level substrate 102.

Referring still to FIG. 6, the substrate 600 can define an inlet 612 to the tortuous channel 610. Whether the vent is incorporated at the component level or at the package level, the inlet 612 can fluidly couple with the front volume 110. For example, when the vent 610 is incorporated in the transducer substrate 105, the inlet 612 to the vent 610 can fluidly couple with the acoustic port 105*a* at a position adjacent the acoustic transducer element 107. Alternatively, when the vent 610 is incorporated in the package substrate 102, the vent can fluidly couple with the front volume 110 at a position adjacent the sound-entry region 101.

In either configuration, the channel 610 can extend predominantly circumferentially around an opening 614 through the substrate 600. For example, the channel 610 can steadily spiral around and radially outward of the opening 614. Alternatively, as shown in FIG. 6, the channel 610 can extend from the inlet 612 circumferentially around the substrate aperture 614 at a substantially constant radial position, and step or otherwise extend outward in a predominantly radial direction at a position 613 near the inlet 612. The circuitous passage 610 can continue to extend around the aperture 614 at each successive radial position until the channel 610 has a desired path length from the inlet 612. A terminal portion 616 of the channel 610 can define an outlet region from the channel at a position laterally or radially outward of the aperture 614 defined by the substrate 600. In FIG. 6, the terminal portion 616 of the channel defines a substantially circular outlet fluidly coupled with the channel. Although not shown in FIG. 6, the terminal portion 616 of the channel 610 can extend to and open from an outer periphery 618 of the substrate 600, directly coupling the channel with the transducer's back volume (e.g., back volume 112 in FIG. 1).

FIG. 6 schematically depicts a volume 620 occupied by a device that is supported by or mounted to the substrate 600. In FIG. 6, the volume 620 can represent an acoustic transducer element (e.g., acoustic transducer element 107 in FIG. 1) of an acoustic transducer, or the volume 620 can represent an acoustic transducer (e.g., MEMS microphone 103 in FIG. 1) mounted to a package substrate (e.g., substrate 102 in FIG. 1). In either case, the device represented by the volume 620 can define an aperture 622 extending from the terminal portion 616 of the channel 610 to a back volume and through the device represented by the volume.

In yet another arrangement, as when an overall dimension of the substrate 600 exceeds an overall dimension of the device represented by the volume 620, the terminal portion 616 of the channel can extend to a region (not shown) of the substrate positioned laterally outward of the volume 620. Such a channel can directly couple the front volume with the back volume of the transducer, without requiring the vent to extend through the transducer or other structure.

Referring still to FIG. 6, the substrate 600 can have a base layer 602 formed of silicon (Si) or another suitable substrate material. An insulator layer 604 can overlie the base layer and be formed of silicon dioxide ($SiO_2$) or polyimide, or another suitable insulator. An aperture 614 can extend through the plurality of layers of the substrate. The insulator layer 604 can define a segment of the tortuous passage 610. For example, the insulator layer 604 can be a sacrificial layer that has been selectively etched to define the channel 610 between walls 611 of remaining insulator. In an arrangement, the channel can be bounded by a lateral etch-stop material, such as, for example, silicon nitride (SiN). The etch-stop 615 (FIG. 9) can define channel walls 611*a*, 611*b* (FIGS. 6 and 9) as the sacrificial material can be selectively etched to remove material between the juxtaposed walls 615 of etch stop, defining a recess and forming a corresponding portion of the tortuous channel 610 extending around the aperture 614.

High-aspect-ratio barometric vents can have a ratio of characteristic-length-to-characteristic-diameter ("L/D ratio") of between about 1,000 and about 32,000, such as for example, between about 2,000 and about 16,000, or for example between about 4,000 and about 8,000. For example, a vent having a hydraulic diameter of 25 μm and an L/D ratio of 32,000 measures about 800 mm in length, while a vent having the same cross-section and an L/D ratio of 8,000 measures about 200 mm in length. Both vent examples have a length several orders of magnitude greater than an ordinate dimension of a package for a microphone transducer.

As yet another example, a substrate 105 for a microphone transducer 103 (FIG. 1) can define a vent having a hydraulic diameter of about 5 μm and a passage length measuring about 80 mm, providing an L/D ratio of 16,000. As another example, a vent having a hydraulic diameter of 5 μm and a passage length measuring about 5 mm in length has an L/D ratio of 1,000.

In general, passage length for a vent can be measured longitudinally from a vent inlet to a vent outlet along a center line through the vent. A center line for a vent that has a cross-sectional shape that varies with longitudinal position can be defined by a curve that passes through the centroid of each cross-section defined by the vent from the inlet to the exhaust. An example of a characteristic diameter for a vent can be a hydraulic diameter (e.g., an area of a cross-section divided by a wetted perimeter of the cross-section) of the vent.

IV. Vented Microphone Transducers and Packages

Figure 8:
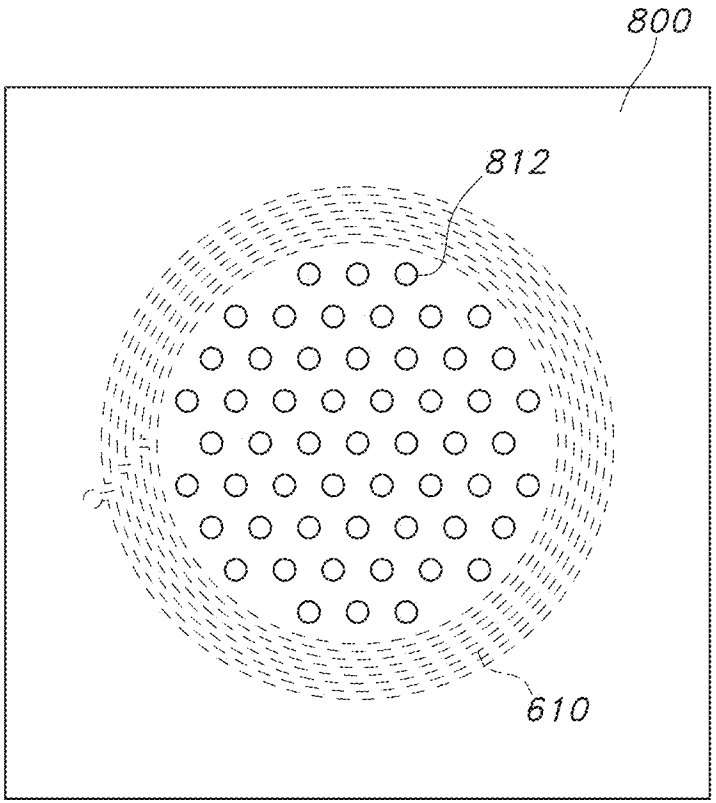
FIG. 8 illustrates a plan view, from above, of an acoustic transducer having an acoustic transducer element mounted to a substrate as in FIGS. 6 and 7.
Figure 7:
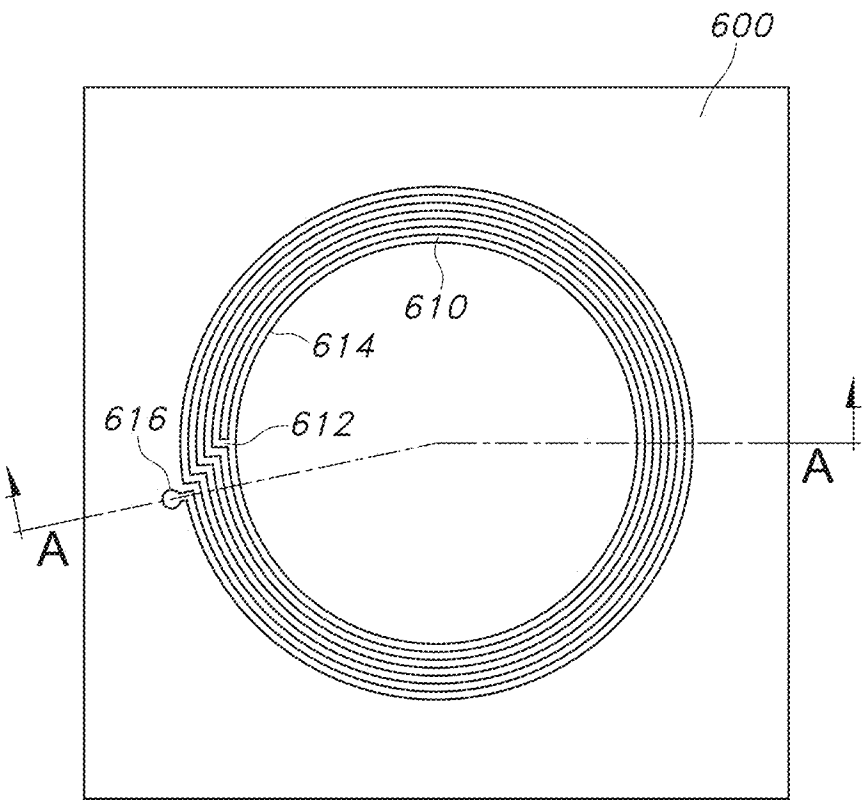
FIG. 7 illustrates a plan view of the substrate shown in FIG. 6 from above.
Figure 9:
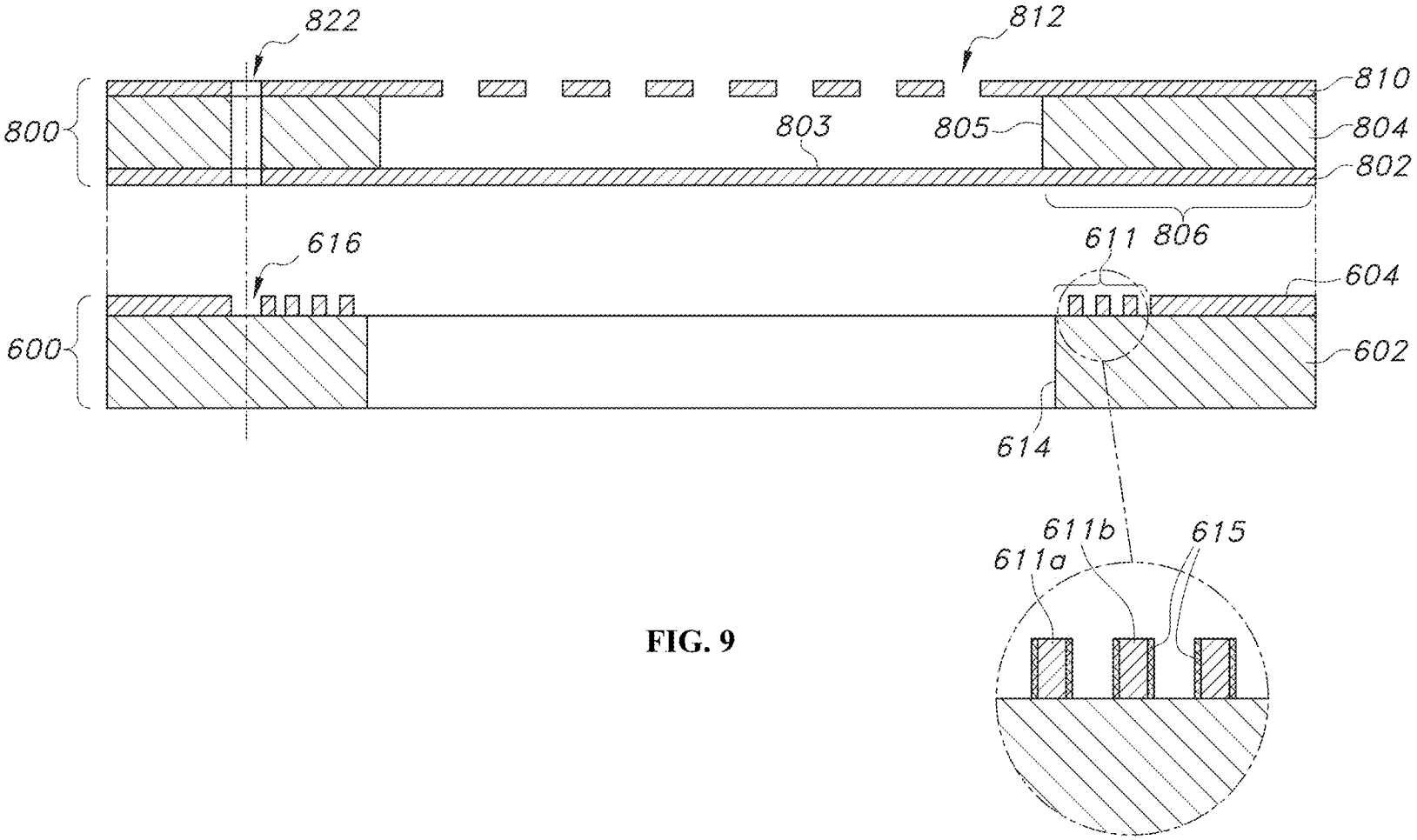
FIG. 9 shows an exploded, cross-sectional view of an acoustic transducer as in FIG. 8, sectioned as along line A-A in FIG. 7.

Referring now to FIGS. 7, 8, and 9, a vented microphone transducer will be described using a high-aspect-ratio vent as an illustrative example of a vent with a complex acoustic impedance, though a segmented or other higher-order vent can be substituted for the high-aspect-ratio vent. The substrate 600 shown in FIG. 7 defines a high-aspect ratio barometric vent 610 circuitously extending outward of an acoustic port 614, generally as described above in relation to FIG. 6. As seen in FIGS. 6 and 7, the elongated barometric vent 610 can circuitously extend from a first end 612 fluidly coupled with the front volume 614 to a second end 616 fluidly coupled with a back volume of the transducer (e.g., through the aperture 622 in FIG. 6). In FIG. 8, an acoustic-transducer element 800 is shown in a top-plan view mounted to the substrate 600 in overlying relation to the channel 610. The exploded view in FIG. 9 shows a side-elevation view of the substrate 600 and the acoustic-transducer element 800 in section, taken along Line A-A in FIG. 7.

As depicted in FIG. 9, the acoustic-transducer element 800 has a single back plate 810 separated from the acoustic diaphragm 802 by an insulator layer 804. The back plate 810 has a plurality of layers, including a conductive layer (e.g., polysilicon) and an insulator layer (e.g., SiN). The diaphragm can be formed of silicon (Si), polysilicon, silicon nitride (SiN), or another material suitable to form a deflectable diaphragm for use in a capacitive microphone transducer.

As shown in FIGS. 8 and 9, the backplate 810 defines a plurality of apertures 812 fluidly and acoustically coupling a backside 803 of the diaphragm 802 with a back volume, e.g., back volume 112 in FIG. 1. The insulator layer 804 defines an aperture 805 having an outer periphery (e.g., circumference) positioned outward of the apertured region of the back plate 810. The aperture 805 defined by the insulator can be larger, smaller or a same size as the acoustic port 614 defined by the substrate. An outer peripheral region 806 of the diaphragm can be attached or bonded with the insulator layer 804 and can overlie and contact the walls 611 defining the tortuous channel 610, closing off a distal edge (relative to the layer 602) of the channel 610. The closed-off distal edge of the channel, in combination with the walls defined by the sacrificial layer 604 and the floor defined by the layer 602, can define an enclosed circuitous passage extending from the inlet 612 to outlet 616 (FIG. 7).

Figure 10:
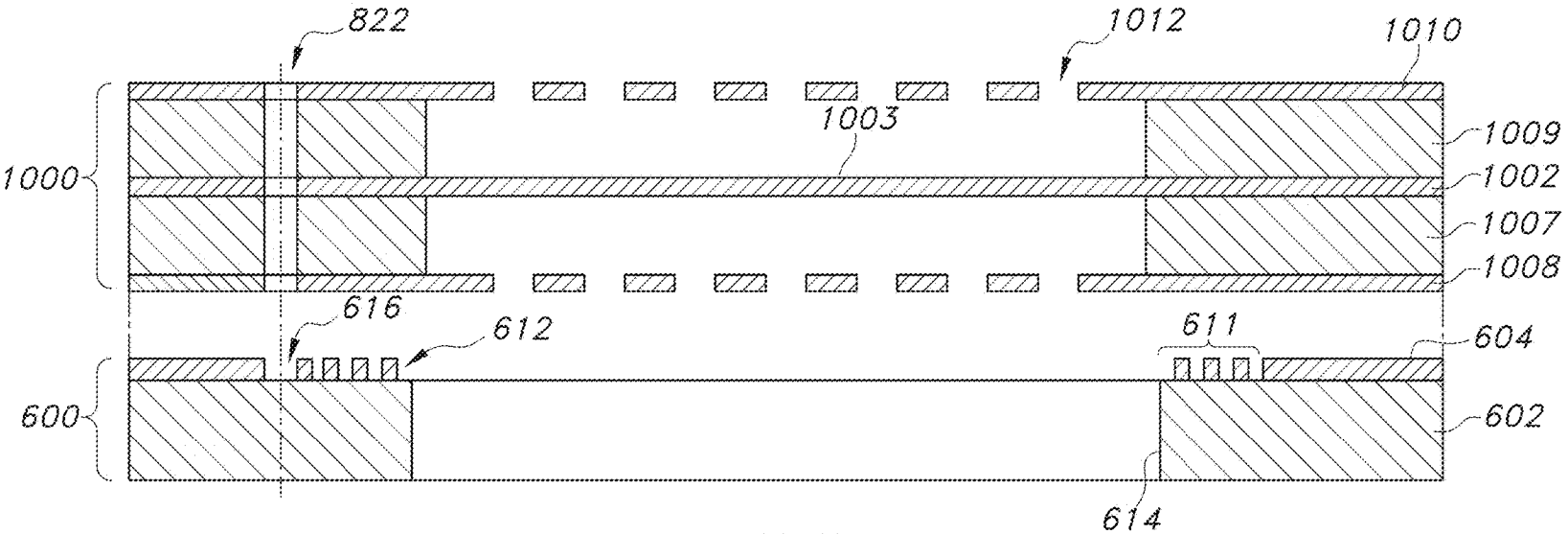
FIG. 10 shows an exploded, cross-sectional view of another acoustic transducer, sectioned as along line A-A in FIG. 7.

FIG. 10 depicts an alternative configuration for an acoustic transducer. In FIG. 10, the substrate is configured similarly to the substrate 600 described in relation to FIGS. 7, 8, and 9. And, the acoustic-transducer element 1000 can contact, attach with or mount to the substrate 600 in a fashion similar as described in relation to FIGS. 7, 8 and 9 to enclose the channel 610 defined by the substrate 600.

However, unlike the acoustic-transducer element 800 in FIG. 9, the acoustic-transducer element 1000 in FIG. 10 has a diaphragm 1002 positioned between first and second opposed back plates 1008, 1010. An insulator 10007, 1009 separates the diaphragm 1002 from each respective back plate 1008, 1010. Each backplate 1008, 1010 can be formed in a manner similar to the back plate 810 in FIG. 9. Similarly, the diaphragm 1002 can be formed of materials similar to the diaphragm 802 in FIG. 9. As well, each back plate 1008, 1010 can define a corresponding plurality of apertures to fluidly and acoustically couple the diaphragm with the front volume and the back volume, respectively, of the diaphragm (e.g., front volume 110 and back volume 112 in FIG. 1).

Figure 11:
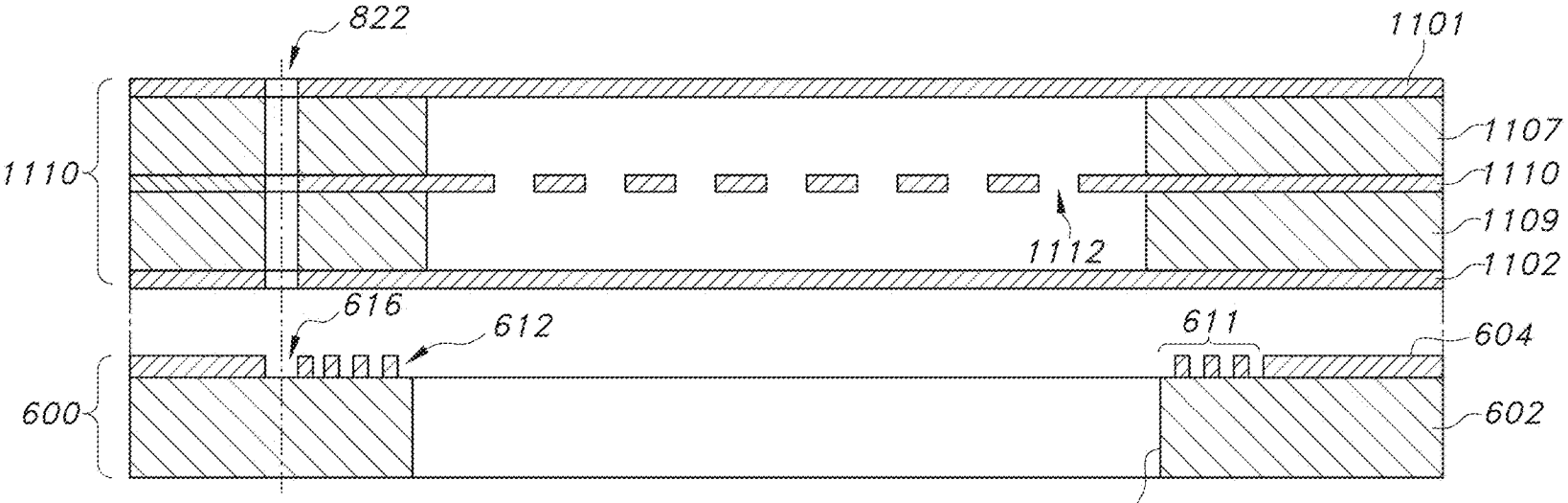
FIG. 11 shows an exploded, cross-sectional view of still another acoustic transducer, sectioned as along line A-A in FIG. 7.

FIG. 11 depicts yet another alternative configuration for an acoustic transducer. In FIG. 11, the substrate 600 is configured similarly to the substrate described in relation to FIGS. 7 through 10. And, the acoustic-transducer element 1100 can contact, attach with or mount to the substrate 600 in a fashion similar as described in relation to FIGS. 7 through 10 to enclose the channel 610 defined by the substrate 600.

However, unlike the acoustic-transducer elements 800 and 1000 in FIGS. 9 and 10, the acoustic-transducer element 1100 in FIG. 11 has a back plate 1100 positioned between first and second opposed diaphragms 1101, 1102. An insulator 1107, 1109 separates each respective diaphragm 1101, 1102 from the back plate 1110. The backplate 1110 can be formed in a manner similar to the back plates described above in relation to FIGS. 9 and 10. Similarly, each diaphragm 1101, 1102 can be formed of materials similar to the diaphragms 802, 1002 described above in relation to FIGS. 9 and 10.

Figure 12:
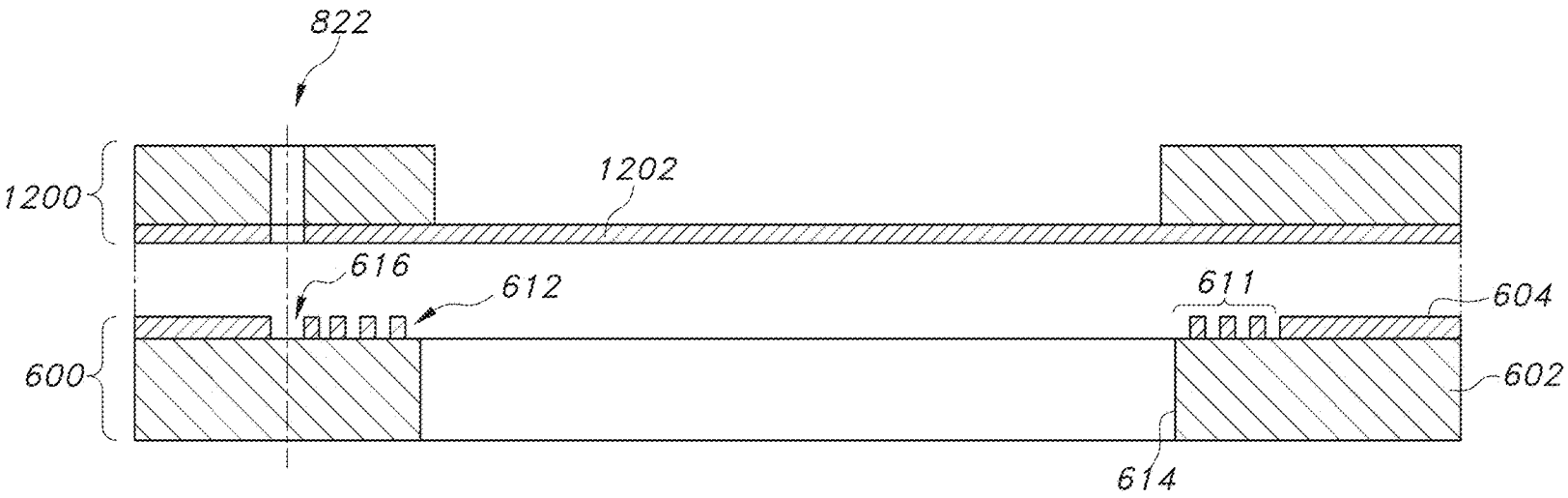
FIG. 12 shows an exploded, cross-sectional view of yet another acoustic transducer, sectioned as along line A-A in FIG. 7.

FIG. 12 depicts still another alternative configuration for an acoustic transducer. In FIG. 12, the substrate 600 is configured similarly to the substrates described in relation to FIGS. 7 through 11. And, the acoustic-transducer element 1200 can contact, attach with or mount to the substrate 600 in a fashion similar as described in relation to FIGS. 7 through 11 to enclose the channel 610 defined by the substrate. Although exploded views shown in FIGS. 9, 10, 11 and 12, it will be understood and appreciated that each respective acoustic transducer element 800, 1000, 1100 and 1200 contacts or otherwise is physically coupled with or supported by the substrate 600 shown in those drawings.

However, unlike the acoustic-transducer elements described above in relation to FIGS. 9 through 11, the diaphragm 1202 in FIG. 12 is a piezoelectric actuator overlying and extending across the acoustic port 614 defined by the substrate 600. In FIG. 12, the acoustic transducer element includes a first substrate 1201 defining a corresponding open port 1203. The piezoelectric actuator 1202 is mounted to the first substrate and extends across the open port 1203 of the first substrate. The acoustic transducer element 1202 is mounted to a second substrate 600 defining the acoustic port 614. When the acoustic transducer element 1200 and the second substrate 600 are assembled together, the open port of the acoustic transducer element is aligned with the acoustic port 614, and the piezoelectric actuator 1202 extends across the aligned open port and acoustic port, defining a boundary therebetween.

The diaphragm 1202 can include a thin-film piezoelectric material, such as, for example, aluminum nitride (AlN) and aluminum scandium nitride (AlScN). Other suitable materials from which to form the piezoelectric diaphragm 1202 can include, for example, $Pb(Zr, Ti)O_3$ and other piezoelectric materials now known or hereafter developed.

A peripheral region of each acoustic-transducer element described above in relation to FIGS. 9 through 12 can define a through-hole aperture 822 aligned with and overlying the outlet 616 from the tortuous vent. The aperture 822 can fluidly couple the vent outlet 616 with the back volume of the transducer, thus coupling the front volume (e.g., front volume 110 in FIG. 1) with the back volume (e.g., back volume 112 in FIG. 1) by way of the tortuous channel 616 and the aperture 822.

Figure 13:
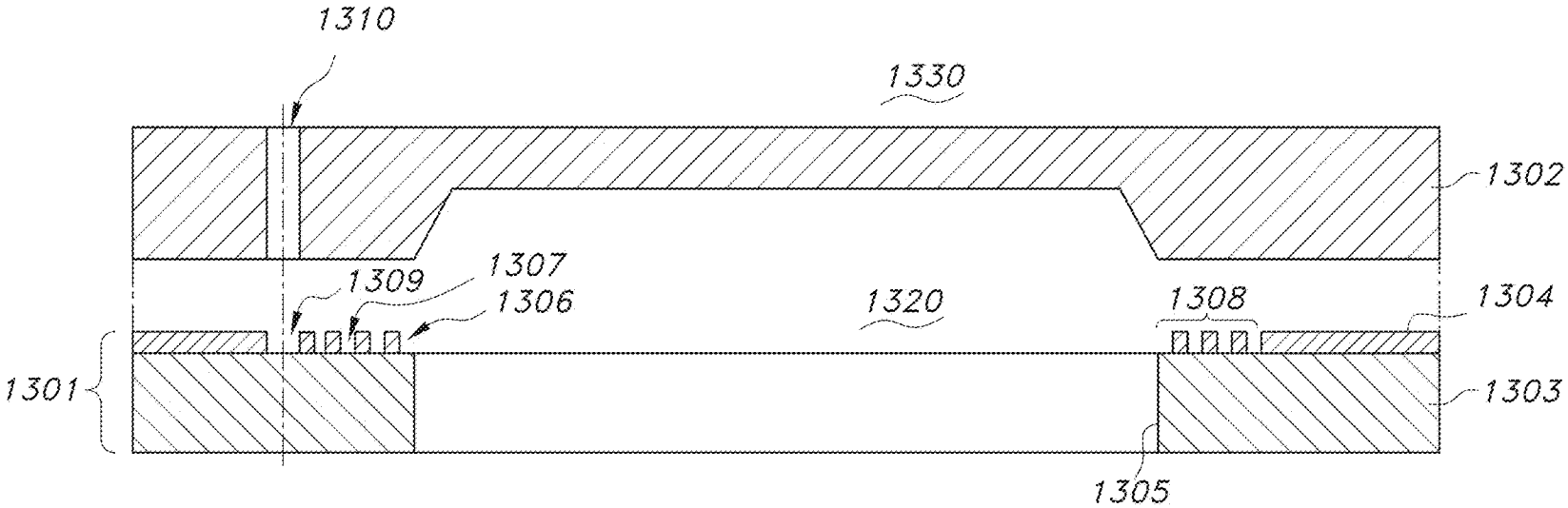
FIG. 13 shows an exploded, cross-sectional view of a packaged microphone transducer having a package substrate incorporating high-aspect ratio barometric vent, sectioned as along line A-A in FIG. 7.
Figure 14:
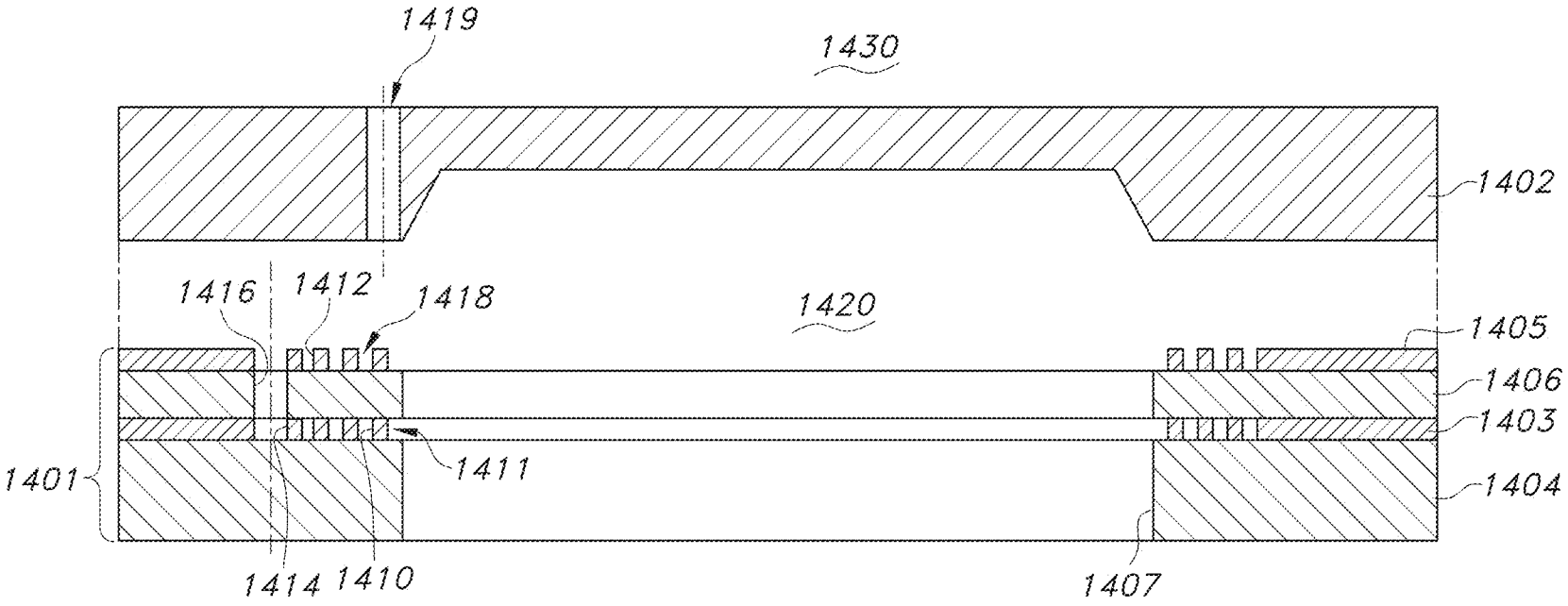
FIG. 14 shows an exploded, cross-sectional view of a packaged microphone transducer having a package substrate incorporating a high-aspect ratio barometric vent structured within, sectioned as along line A-A in FIG. 7.

The tortuous channels described above in relation to FIGS. 9 through 12 represent high-aspect-ratio arrangements of vents having a complex acoustic impedance. The vents are formed in or by a substrate for a microphone transducer, e.g., a substrate 105 in FIG. 1. However, as noted above in relation to FIG. 6, a venting having a higher-order complex acoustic impedance can be formed in or by a transducer substrate. As well, package-level substrates, e.g., substrate 102 in FIG. 1, can also define high-aspect-ratio vent having a complex acoustic impedance, as well as higher-order vents of the type described more fully below. FIGS. 13 and 14 depict two package-level substrates defining a vent with a complex acoustic impedance suitable for use in a package for an acoustic transducer. Although exploded views are shown in FIGS. 13 and 14, it will be understood and appreciated that each respective acoustic transducer 1302, 1402 contacts or otherwise is physically coupled with or supported by the corresponding substrate 1301, 1401 shown in those drawings.

FIG. 13 depicts an exploded view of a MEMs microphone transducer mounted to a package-level substrate defining a vent with a complex acoustic impedance embodied as a tortuous channel, similar to the arrangement shown in FIG. 6. The MEMs microphone transducer 1302 shown in FIG. 13 can incorporate an acoustic-transducer element according to any of the arrangements described above in relation to FIGS. 9 through 12. As in FIG. 6, the substrate 1301 has an upper layer 1304 and a lower layer 1303. The upper layer 1304 of the multi-layer substrate 1301 shown in FIG. 13 has been selectively etched (or otherwise processed) to define a high-aspect ratio acoustic pathway 1307. The microphone transducer 1302 can define an aperture 1310 fluidly coupling the outlet 1309 from the pathway 1307 to the back volume 1330 of the microphone. And, the pathway 1307 extends from an inlet 1306 to the outlet 1309, fluidly coupling the acoustic port 1305 or other region of the front volume 1320 with the back volume 1330 of the microphone transducer 1302 by way of the pathway 1307 and the aperture 1310. More particularly, the pathway 1307 can extend along an outwardly expanding spiral, e.g., a radius of curvature of the pathway can continuously increase with longitudinal position along the pathway moving from the inlet 1306 to the outlet 1309. Alternatively, the pathway can extend circumferentially around the acoustic port 1305 with a substantially constant radius, and in a selected region of the substrate, the pathway can extend in a predominantly radial direction from one ring to an adjacently positioned, successively larger-radius ring. The channel 1307 can be defined between juxtaposed walls 1308. FIG. 6 and FIG. 7 depict a high-aspect ratio vent 610 having such a sequence of successively larger-radius rings joined together by relatively short, radially extending segments 613. As with the channel 610 in FIG. 6, the channel 1307 can extend to an outer periphery of the substrate or extend laterally outward of the MEMs component 1302, directly coupling the front volume 1320 with the back volume 1330.

FIG. 14 depicts an exploded view of a MEMs microphone transducer 1402 mounted to an alternative arrangement of a package-level substrate 1401 defining a high-aspect ratio vent 1410. In FIG. 14, the substrate 1401 has four layers (though additional or fewer layers are possible), with alternating insulative layers 1404, 1406 being substantially continuous, and alternating sacrificial layers 1403, 1405 having been selectively etched (or otherwise processed) to define corresponding segments 1410, 1412 of a high-aspect ratio acoustic pathway. As with package-level substrates described above, the substrate 1401 in FIG. 14 defines a sound entry region (or acoustic port) 1407. An inlet 1411 to the vent fluidly couples with the acoustic port 1407, providing a direct fluid coupling of a first sinuous segment 1410 of the vent with the front volume 1420. The first sinuous segment 1410 extends through successively larger radius passages, similarly to the vent described above in relation to FIG. 13, until it meets a first outlet region 1414.

FIG. 14 shows a substantially continuous layer 1406 overlying the first sinuous segment 1410. The layer 1406 defines an aperture 1416, or open via, aligned with the first outlet region 1414 of the first sinuous segment 1410. The upper layer 1405 of the substrate 1401 defines a second sinuous segment 1412 of the barometric vent, and the aperture 1416 fluidly couples the first sinuous segment 1410 with the second sinuous segment 1412. The second sinuous segment 1412 extends circumferentially around the acoustic port 1407 through successively smaller-radius passages until the second sinuous segment 1412 meets a second outlet region 1418. The successively smaller-radius passages can be defined by a continuously decreasing-radius spiral or can have substantially constant radius segments, with adjacent segments joined together with a predominantly radially extending segment, as with the rings depicted in FIG. 6. In some arrangements, the layer 1406 can be omitted, providing a direct coupling between the first sinuous segment 1410 and the second sinuous segment 1412. As with the acoustic transducer 1302 shown in FIG. 13, the acoustic transducer 1402 shown in FIG. 14 can define a through-hole aperture 1419 fluidly coupling the second outlet region 1418 with the back volume 1430. By including one or more convolutions (or other change in channel direction) as just described (e.g., a combination of an outwardly expanding segment 1410 with an inwardly contracting segment 1412), overall packing density of a high-aspect ratio vent can be further increased.

V. Performance Examples

An acoustic vent having an L/D ratio of between about 1,000 and about 32,000 has a large acoustic mass, as with high-aspect-ratio vents described above. Such a vent can thus damp flow through the vent when excited by pressure variations having a frequency above a threshold frequency, reducing leakage noise compared to leakage noise arising from a predominantly resistive acoustic vent. For example, vents having a complex acoustic impedance described herein can substantially reduce leakage noise at frequencies above a threshold of between about 30 Hz and about 150 Hz, such as, for example, above threshold frequencies between about 40 Hz and about 100 Hz, e.g., above threshold frequencies between about 50 Hz and about 80 Hz. Stated differently, such a vent can act as a low-pass filter, e.g., to airflow, having a cutoff frequency between about 30 Hz and about 150 Hz.

Figure 16:
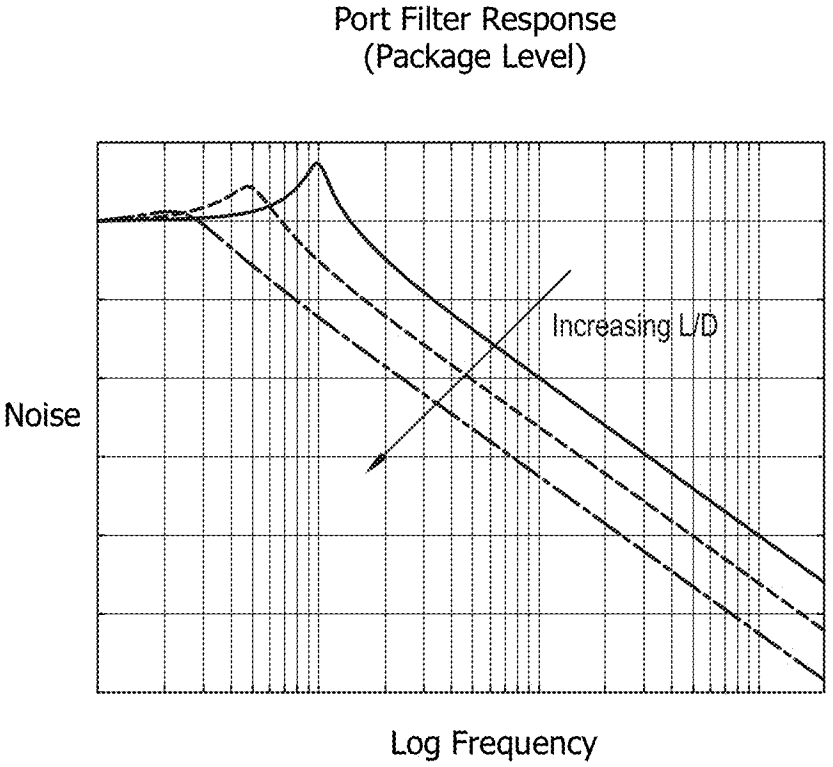
FIG. 16 shows a plot of filter response for several high-aspect-ratio barometric vents defined by a substrate (e.g., FIGS. 13 and 14) for a package for an acoustic transducer.
Figure 15:
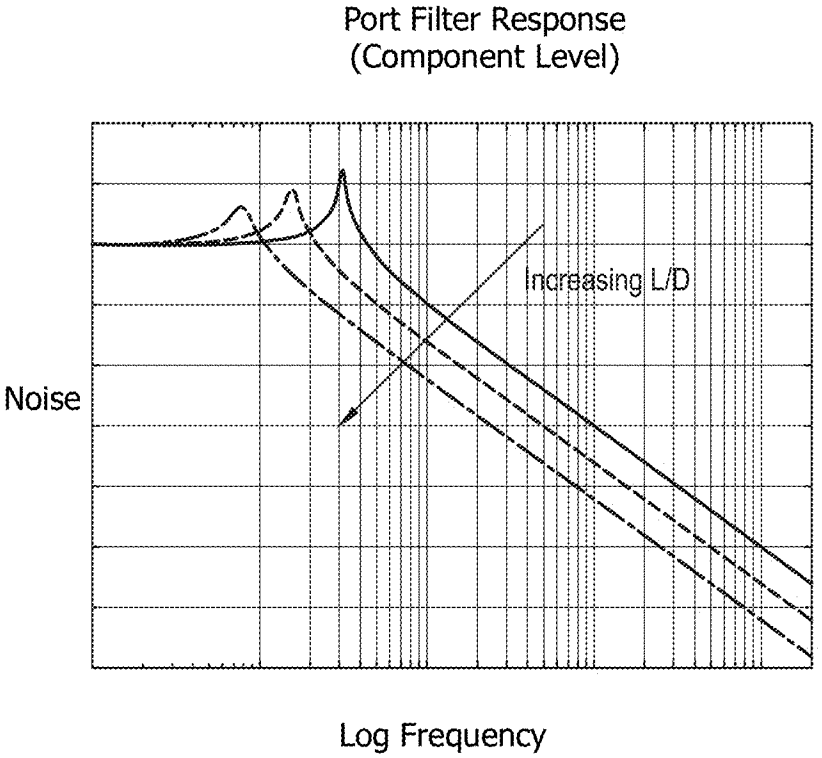
FIG. 15 shows a plot of filter response for several a high-aspect-ratio (second-order) barometric vents defined by a substrate (e.g., FIGS. 6 through 12) for an acoustic transducer.

The plot in FIG. 15 shows representative acoustic responses to component-level vents. The plot in FIG. 16 shows representative acoustic responses to package-level vents. Both plots generally depict similar trends, e.g., as aspect ratio of a high-aspect ratio vent increases, resonant frequency of the barometric vent decreases, as does the magnitude of the resonance.

In a general sense, reducing the resonance peaks as much as possible is preferred, though that can drive aspect ratios toward or even above 32,000. Thus, volume available to route the high-aspect-ratio barometric vent may impose an upper threshold on feasible length for the vent. Nonetheless, compensation with a digital signal processor (DSP) may be possible when manufacturing tolerances can be controlled sufficiently that the resonance frequency is essentially the same across devices. Such a DSP can be embodied in software, firmware or hardware (e.g., an ASIC). A DSP processor may be a special purpose processor such as an application specific integrated circuit (ASIC), a general purpose microprocessor, a field-programmable gate array (FPGA), a digital signal controller, or a set of hardware logic structures (e.g., filters, arithmetic logic units, and dedicated state machines), and can be implemented in a general computing environment as described herein.

That being said, if a given venting arrangement exhibits a substantial resonance peak (e.g., as with the responses shown in FIGS. 15 and 16 at lower aspect ratios), the structure may be physically more responsive to a infrasonic input or an input at or near the sonic fringe. As a consequence, a low frequency input like a foot fall, which does not have much perceptible "sound" associated with it, could, in theory, produce significant levels of low-frequency noise if it overlaps with a resonant peak in the vent response, which in turn can substantially increase a high output level by the transducer. Consequently, a user may hear an increased noise level without really being aware of a corresponding a physical stimulus driving the noise. Alternatively, compensation, e.g., compensation by a DSP, can remove some or all of the resonance arising from excitation at or below a sonic fringe.

Moreover, such enhanced sensitivities at or below the sonic fringe can be exploited to detect events, e.g., infrasonic events such as, for example, foot falls. By way of example, resonance arising from an external source can be detected by a microphone transducer, or circuitry that receives an audio signal from the transducer. Additionally, selected sources or classes of infrasonic activity can have unique spectral signatures. Accordingly, in some instances, the microphone or the system may be able to detect a presence of a infrasonic event, as well as to classify the event, e.g., in correspondence with a level of resonance, alone, or in relation to energy content in other bands.

VI. Vents Having Higher-Order Complex Acoustic Impedance

Figure 17A:
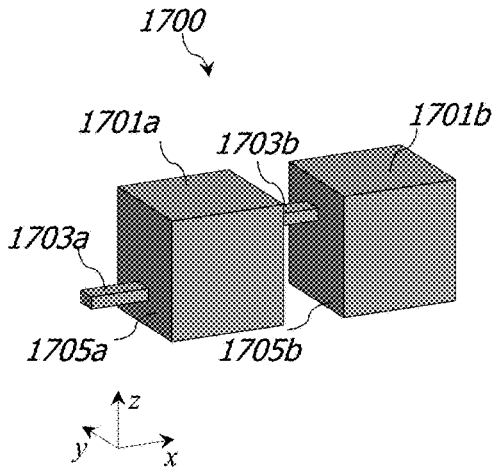
FIGS. 17A and 17B show a perspective view of a portion of a segmented channel defining a barometric vent.
Figure 17B:
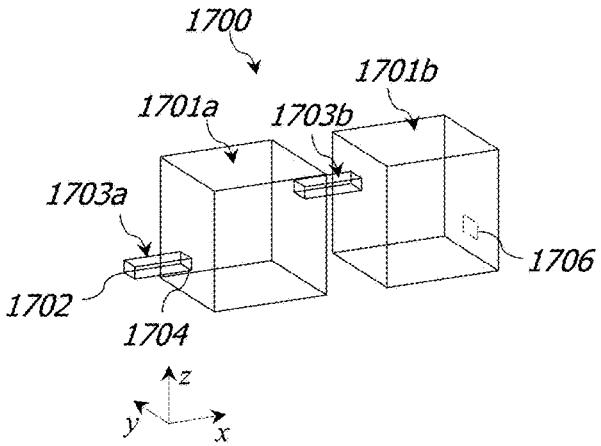
Figure 17C:
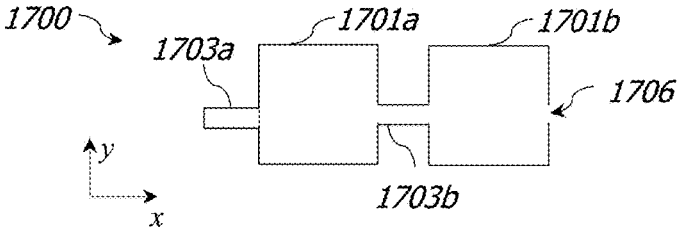
FIG. 17C shows a two-dimensional projection of the segmented channel shown in FIGS. 17A and 17B onto a plane.

Referring now to FIGS. 17A, 17B and 17C, another example of a vent with a complex acoustic impedance that has a second-order roll off is shown and described. The elongated channel 1700, segmented as shown in FIGS. 17A, 17B and 17C, can define a barometric vent between a front volume and a back volume of a MEMS microphone. In FIG. 17A, the substrate walls defining the segmented channel 1700 are omitted to reveal the open internal volume of the segmented channel. Stated differently, the shaded regions of the segmented channel in FIG. 17A depict the open volume within the channel 1700 occupied by an acoustic medium (e.g., air). The segmented channel 1700 has chamber portions 1701*a*, 1701*b* and duct portions 1703*a*, 1703*b* juxtaposed with the chamber portions. Each duct portion has a substantially smaller cross-sectional area than a corresponding cross-sectional area of an adjacent chamber portion. For example, in FIG. 17*a*, a cross-sectional area of the duct portions 1703*a*, 1703*b* in a y-z plane is substantially smaller than a cross-sectional area of the chamber portions 1701*a*, 1701*b* in a y-z plane.

The duct portion 1703*b* extends from one of the chamber portions 1701*a* to the adjacent chamber portion 1701*b*, providing a contraction in cross-sectional area from the chamber portion 1701*a* into the duct portion 1703*b* and an expansion in cross-sectional area from the duct portion to the adjacent chamber portion 1701*b*. Consequently, chamber portions of the segmented channel 1700 provide acoustic compliance to the segmented channel and the duct portions of the segmented channel provide acoustic mass to the segmented channel. In the following discussion, duct portions of segmented channels are referred to generally as mass units and chamber portions of segmented channels are referred to generally as compliance units.

In FIG. 17B, the segmented channel 1700 is shown with shading removed to reveal internal fluid connections as among the compliance units 1701*a*, 1701*b* and mass units 1703*a*, 1703*b*, while still showing the edges and corners of each unit. FIG. 17C shows a two-dimensional projection on the x-y plane of the passageway defined by the segmented channel 1700. The mass unit 1703*a* extends from an open proximal end 1702 to an open distal end 1704. The open proximal end 1702 of the mass unit 1703*a* can fluidly couple with a front volume (not shown) or other acoustic chamber of a microphone transducer. The open distal end 1704 of the mass unit 1703*a* can fluidly couple with the compliance unit 1701*a* through a selected face of the compliance unit, e.g., the proximal face 1705*a* (FIG. 17A) along the x-axis.

Similarly, the mass unit 1703*b* extends from an open proximal end to an open distal end. The open proximal end of the mass unit 1703*b* can fluidly couple with the compliance unit 1701*a* through a selected face (e.g., the face positioned distally of the proximal face 1705*a* along the x-axis). The open distal end of the mass unit 1703*b* can fluidly couple with the compliance unit 1701*b* through a selected face of the compliance unit, e.g., the proximal face 1705*b* (FIG. 17A). A selected face of the second compliance unit 1701*b* (e.g., the face positioned distally of the proximal face 1705*b* along the x-axis) can define an opening 1706. The opening 1706 can be directly or indirectly fluidly coupled with a back-volume or other acoustic chamber of the microphone transducer.

Each compliance unit 1701*a*, 1701*b* has a comparatively larger open internal volume (e.g., cross-sectional area and length) compared with the open internal volume (e.g., cross-sectional area and length) of each respective mass unit 1703*a*, 1703*b*. Although the dimensions of the compliance units 1701*a*, 1701*b* are shown as being the same in FIG. 17A, the dimensions of each compliance unit 1701*a*, 1701*b* may be selected differently from each other to provide a desired overall tuning of the segmented channel 1700. Similarly, the dimensions of the mass units 1703*a*, 1703*b* may be the same as or different from each other.

Accordingly, a segmented channel can provide relatively more degrees-of-freedom, and thus offers relatively more flexibility in tuning, as compared to a tortuous, high-aspect-ratio channel. For example, a length (e.g., along the x-axis in FIGS. 17A, 17B and 17C) and a cross-sectional area (e.g., in the y-z plane) of each mass unit 1703*a*, 1703*b* can be selected to achieve a desired acoustic mass within each segment. Moreover, viscous losses associated with each mass unit 1703*a*, 1703*b* can be tuned by adjusting relative position in the y-z plane. And, although only a single mass unit 1703*a*, 1703*b* is shown for each segment of the channel 1700, more than one mass unit can extend between adjacent compliance units (e.g., units 1701*a*, 1701*b*) to reduce the acoustic mass for a given segment, providing additional options to tailor a response of the segmented channel 1700. One or more further segments, each having a corresponding mass unit and a corresponding compliance unit, can be added to the segmented channel 1700 shown in FIGS. 17A, 17B and 17C.

Figure 18:
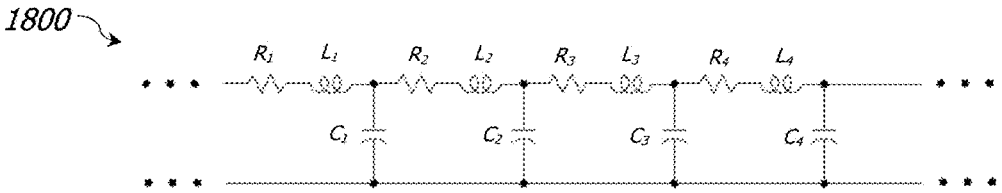
FIG. 18 shows an electrical-circuit analog to an acoustic filter defined by a segmented channel that defines a barometric vent.

FIG. 18 shows an analogous electric circuit 1800 representing a segmented channel having four cascaded mass and compliance units. In the electrical circuit 1800, the resistive, inductive and capacitive elements $R_1$, $L_1$, and $C_1$ are analogous to the acoustic conductance, the acoustic compliance, and the acoustic mass, respectively, of the first segment (1701*a*, 1703*a*) of the channel 1700. Similarly, the resistive, inductive and capacitive elements $R_2$, $L_2$, and $C_2$ are analogous to the acoustic conductance, the acoustic compliance, and the acoustic mass, respectively, of the second segment (1701*b*, 1703*b*) of the channel 1700.

Referring still to FIG. 18, the elements $R_3$, $L_3$, and $C_3$ and $R_4$, $L_4$, and $C_4$ correspond, respectively, to a third segment (e.g., units 1901*c*, 1903*c* in FIG. 19) and a fourth segment (e.g., units 1901*d*, 1903*d* in FIG. 19) of mass and compliance units. Cascaded mass and compliance structures, as in FIGS. 18 and 19, can achieve a higher order roll off than that achieved by, for example, the two-segment channel 1700. The roll-off order increases in correspondence to an increasing number of repeating mass/compliance units.

Figure 19:
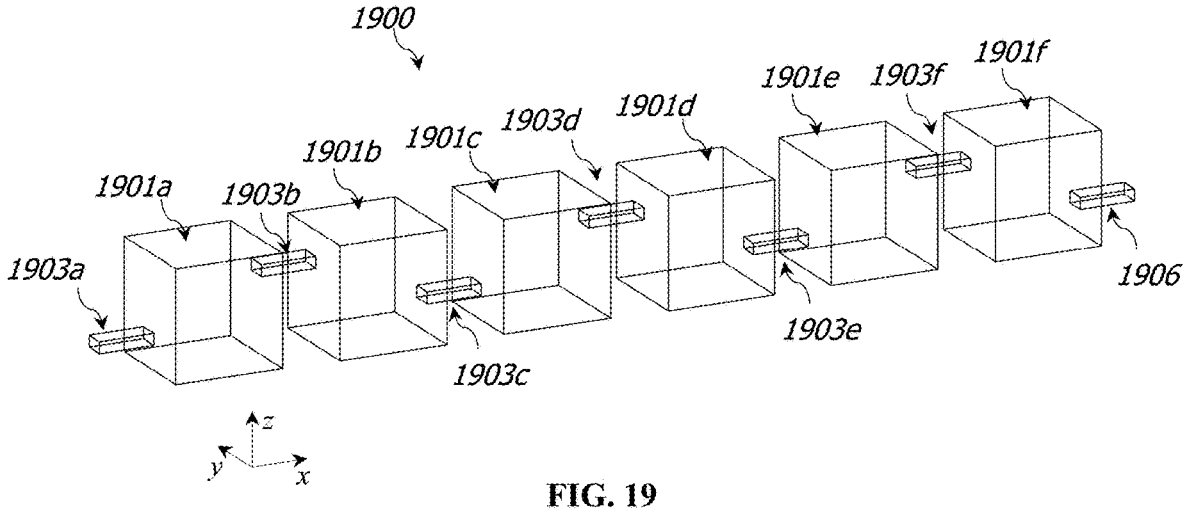
FIG. 19 shows a perspective view of a segmented channel defined by a cascade of six repeating duct and chamber units.
Figure 20:
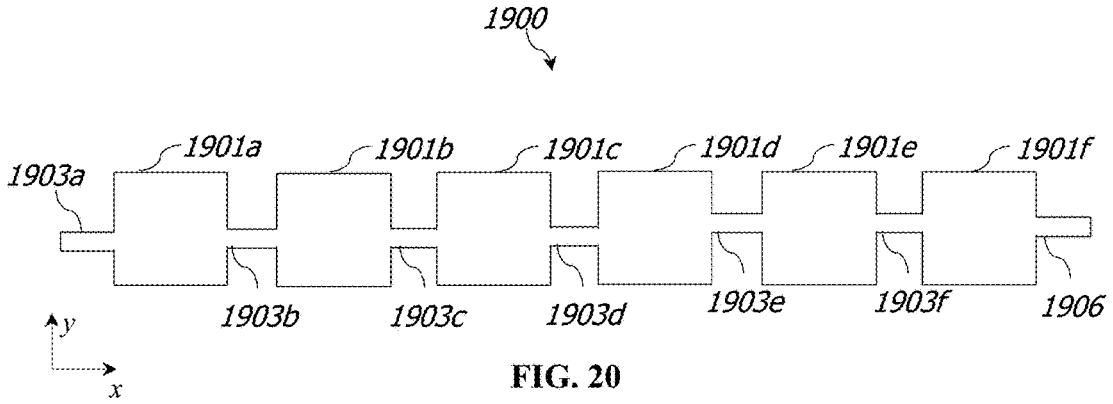
FIG. 20 shows a two-dimensional projection of the segmented channel shown in FIG. 19.
Figure 21A:
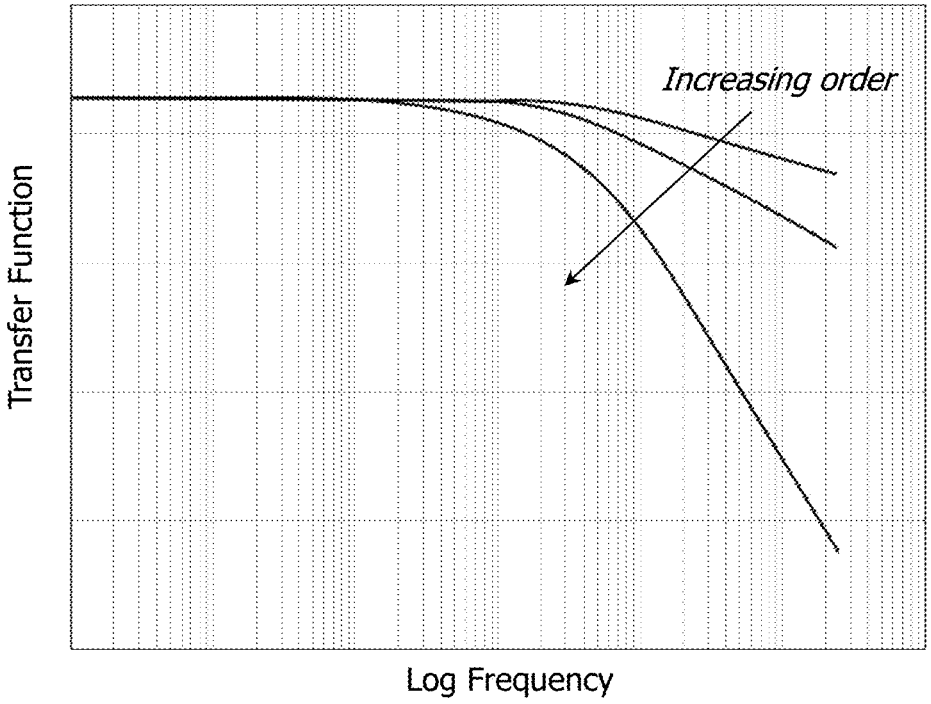
FIG. 21A shows a plot demonstrating low-frequency roll off for several different orders of acoustic filter, each defined by a respective segmented channel having a corresponding cascade of repeating duct and chamber units.

For example, the segmented channel 1900 shown in FIGS. 19 and 20 includes a fifth cascade (e.g., units 1901*e*, 1903*e*) and a sixth cascade (e.g., units 1901*f*, 1903*f*) of mass and compliance units. As shown in FIG. 21A, cascading the segments of mass and compliance units can reduce the cutoff frequency of the segmented barometric vent 1900, e.g., compared to the segmented channel 1700. Vent noise can be filtered out across higher frequencies on the noise spectrum using higher-order vents by achieving a steeper roll-off compared to that achieved by a high-aspect-ratio vent. Consequently, signal-to-noise ratio for a microphone can be improved using a higher-order vent.

Figure 21B:
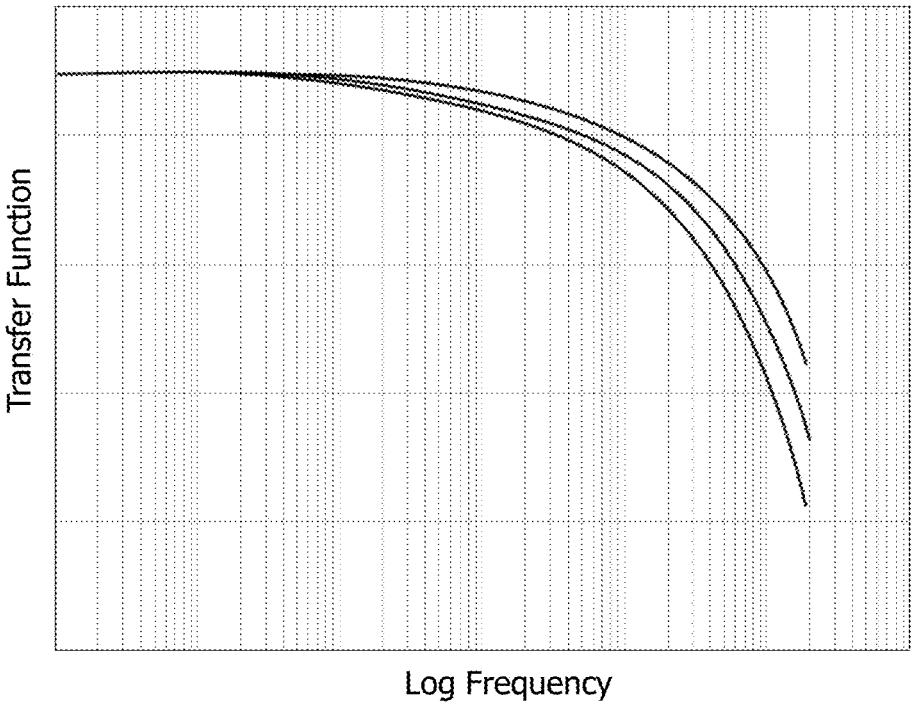
FIG. 21B shows variation in low-frequency roll off for several segmented channels having similar cascades of repeating duct and chamber units, albeit with different dimensions for each cascade.

For a given microphone back volume and a selected number of cascaded segments of mass and compliance units, dimensions of each mass and compliance unit can be tuned to achieve a desired roll off. For example, viscous losses through the high mass units can be tuned to adjust damping. More generally, each of the cascaded segments can be tuned to have a selected combination of acoustic mass and acoustic compliance (e.g., high/high, high/low, low/high, respectively) to achieve a desired cut-off frequency and corresponding microphone frequency response. FIG. 21B shows an example of variation in roll off for a different tunings of a given cascade of mass and compliance units.

In one illustrative example, dimensions of the segmented channel 1900 (having 6 segments) can be selectively tuned to provide selected roll-off frequencies when used to barometrically vent a back volume having a volume of 2.5 $mm^3$. For example, the x-, y-, and z-dimensions of each compliance unit 1901*n* can be selected to be 400 μm, 500 μm, and 400 μm, respectively, and the x- and y-dimensions of each mass unit 1903*n* can be selected to be 60 μm, and 10 μm, respectively. The z-axis dimension, t, of each mass unit can be varied and a corresponding roll-off frequency determined. In this example, the z-axis dimension, t, varied from 20 μm to 50 μm in increments of 5 μm, and the resulting low-frequency roll-off occurred at 8 Hz, 12 Hz, 16 Hz, 23.5 Hz, and 32.5 Hz, respectively.

Figure 22A:
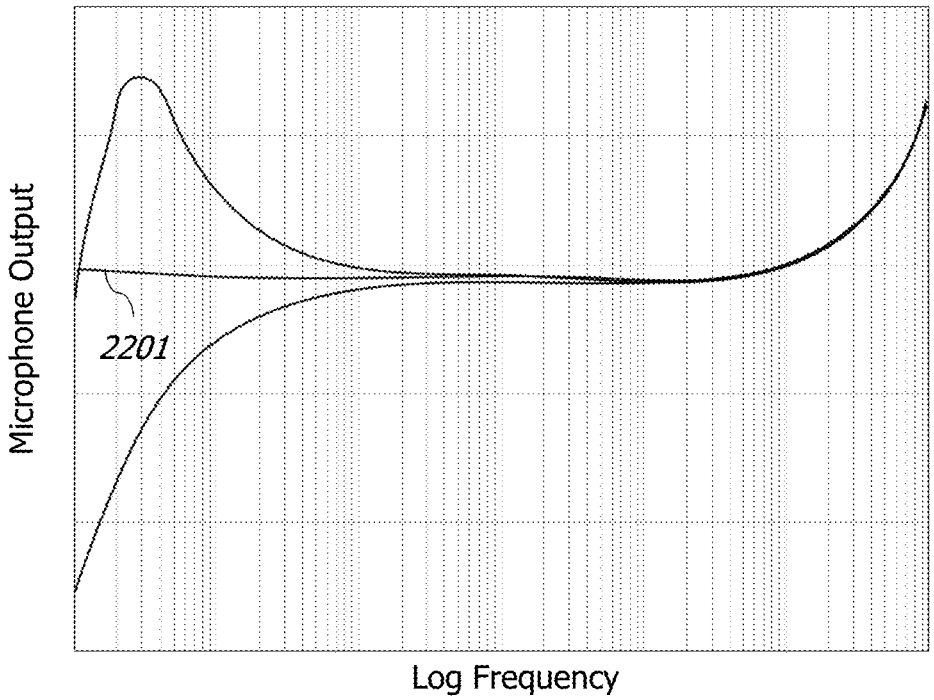
FIGS. 22A and 22B show respective plots of frequency and phase response for a microphone vented with different segmented channels.
Figure 22B:
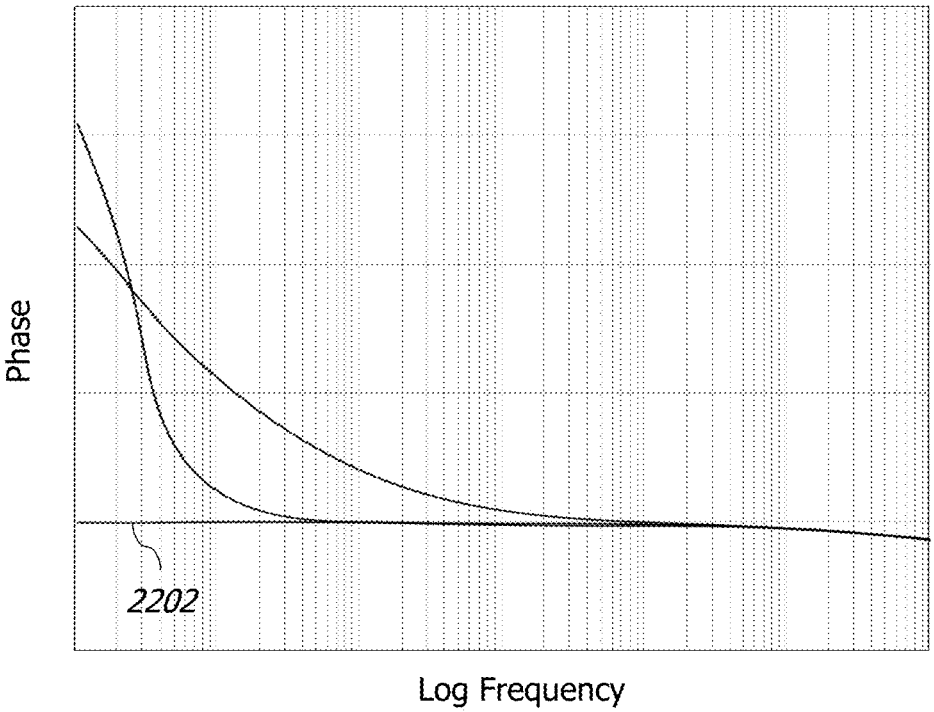

Referring now to FIGS. 22A and 22B, representative frequency responses and phase responses, respectively, of a microphone back whose back volume is barometrically vented using different second-order, under-damped vents. Notably, the frequency response 2201 and phase response 2202 flatten over the audible bandwidth when the low-frequency roll-off falls below a lower-threshold frequency, e.g., 20 Hz. Moreover, phase mismatch common among conventional designs can be reduced or minimized using higher-order vents described herein. Although the responses shown in FIGS. 22A and 22B result from a second-order filter, the responses will also flatten with higher-order filters as shown in, for example, FIG. 19.

And, in some respects, an elongated, segmented channel can more readily be manufactured, packaged, and reliably tuned than a high-aspect ratio vent described above. For example, a segmented channel as described above can have an overall volume about one-tenth of that required for a high-aspect ratio vent as described above in relation to, for example, FIG. 6. As well, a segmented channel can provide more degrees-of-freedom for tuning the filtering provided by the channel.

Further, cascaded segments of a higher-order, segmented vent need not be combined along a single coordinate direction, as with the vent 1900 shown in FIG. 19. Rather, each successive segment of mass and compliance units can be added to a previous segment in any orientation subject to any physical constraints imposed by a given microphone or package. As well, the number of cascaded segments (e.g., the vent order) can be selected in accordance with each desired application.

Figure 23:
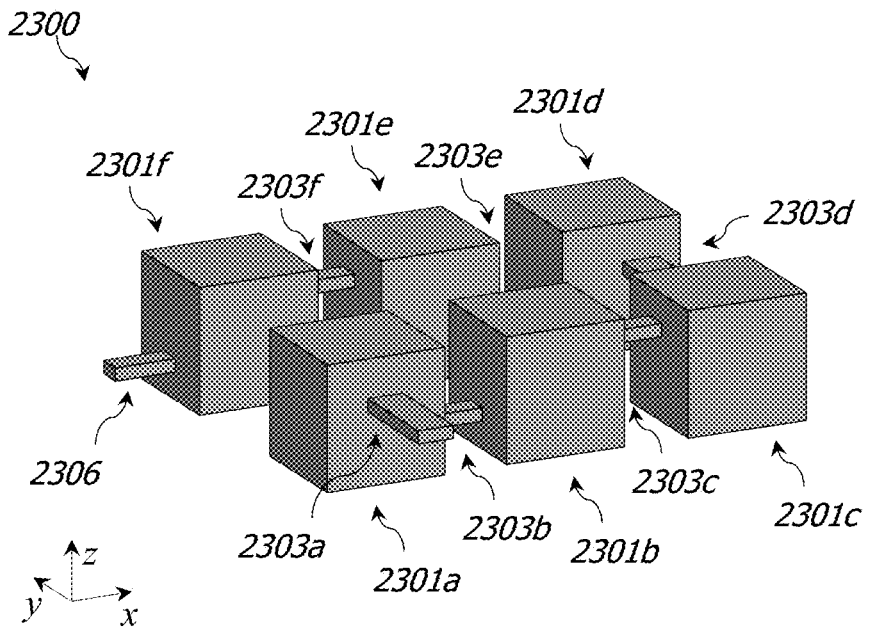
FIG. 23 shows a perspective view of a segmented channel having a cascade of repeating duct and chamber units.
Figure 24:
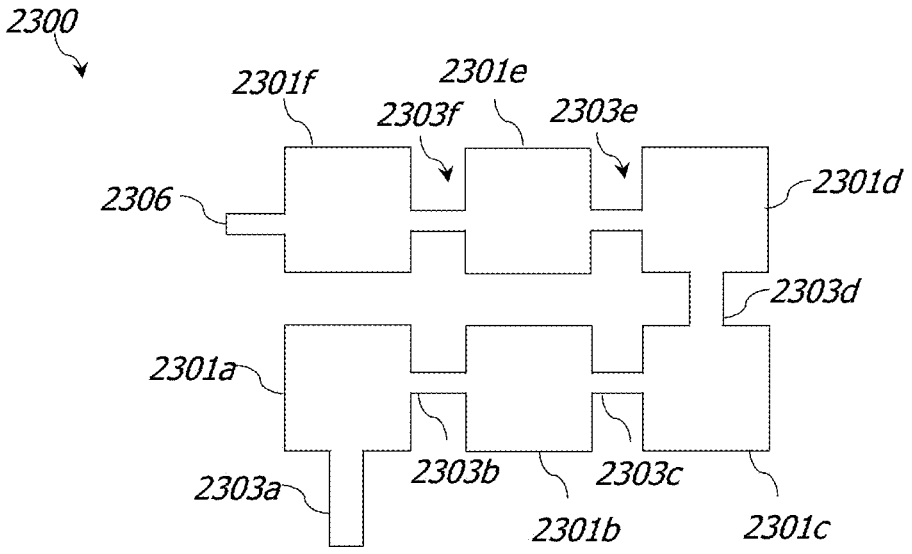
FIG. 24 shows a two-dimensional projection of the segmented channel shown in FIG. 23.

For example, in FIGS. 23 and 24, the segmented vent 2300 is shown having six segments arranged in a U-shape parallel to an x-y plane. More specifically, a first segment has a compliance unit 2301*a* and a mass unit 2303*a*. The mass unit 2303*a* has a major longitudinal axis extending in a y-axis direction from a proximal end (e.g., coupled with a front volume, not shown) to a distal end opening to an x-z face of the compliance unit 2301*a*.

The second segment is oriented in a different direction, rotated 90-degrees about the z-axis. For example, the proximal end of the second segment's mass unit 2303*b* couples with a y-z face of the compliance unit 2301*a* and the mass unit 2303*b* extends in an x-axis direction to couple with a y-z face of the compliance unit 2301*b*. The third segment (unit 2303*c* and 2301*c*) is oriented generally as the second segment. However, the fourth segment (mass unit 2303*d* and compliance unit 2301*d*) is rotated 90-degrees in a direction opposite the rotation of the second segment, providing the fourth segment with an orientation similar to that of the first segment (mass unit 2303*a* and compliance unit 2301*a*). And, the fifth segment (mass unit 2303*e* and compliance unit 2301*e*) is again rotated about a z-axis by another 90-degrees relative to the fourth segment, orienting the fifth segment at 180-degrees relative to the second segment. The sixth segment (mass unit 2303*f* and compliance unit 2301*f*) is oriented as the fifth segment, with a channel 2306 provided to couple the compliance unit 2301*f* with a back volume (not shown).

Figure 25:
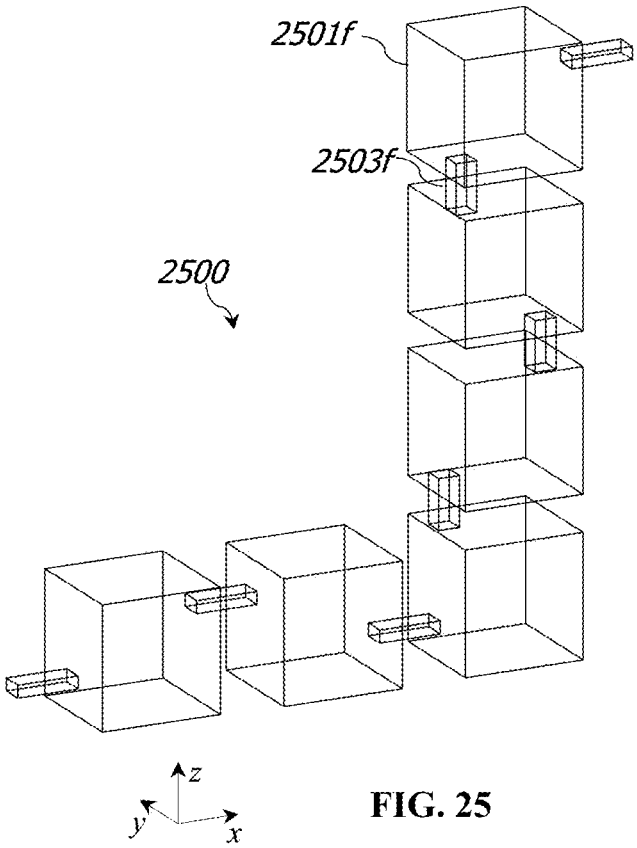
FIG. 25 shows a perspective view of another segmented channel having a cascade of repeating duct and chamber units.
Figure 26:
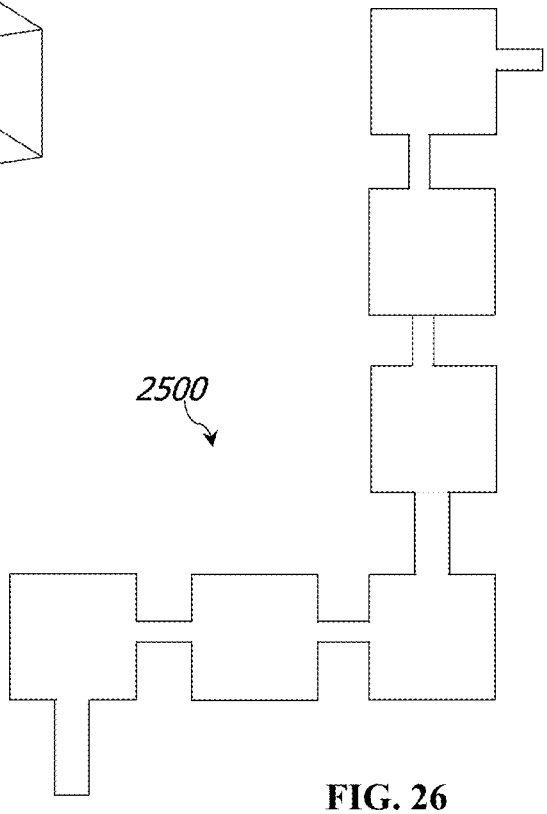
FIG. 26 shows a two-dimensional projection of the segmented channel shown in FIG. 25.

FIGS. 25 and 26 show yet another alternative arrangement of a segmented vent. In FIGS. 25 and 26, the segments are arranged to provide the vent 2500 with an L-shape parallel to an x-z plane. Still other arrangements are possible. For example, the sixth segment 2501*f*, 2503*f*, shown in FIG. 25 as extending in a z-axis direction from the prior segment can alternatively extend in a y-axis direction from that prior segment.

In general, such segmented vents can be made compact in one or more coordinate directions by adding successive segments in a different orientation compared to the prior segment. For example, as shown in FIG. 23, a vent defined by a segmented channel can loop back on itself, providing a desired number of segments (e.g., to achieve a desired higher-order filter) while not extending along a single coordinate direction. By including one or more convolutions (or other change in channel direction or orientation), overall packing density of a segmented channel vent can be further increased.

As well, vents with complex acoustic impedance, as described herein, can be positioned between the back volume and the front volume, over a MEMS device, or anywhere within a package, substrate or lid, with any selected compact orientation. For example, a segmented channel described in relation to any of FIGS. 17A through 26 can be substituted for a high-aspect-ratio vent described above in relation to any of FIGS. 1 through 16. Similarly, a segmented channel can be manufactured using techniques described above in connection with high-aspect-ratio vents described above in relation to FIGS. 1 through 16. In the foregoing discussion, duct portions and chamber portions of segmented channels are described generally as being rectangular, prismatic structures within a Cartesian coordinate system. Nonetheless, duct portions and chamber portions are not so limited; they may have other regular or irregular three-dimensional shapes. Moreover, the wetted surfaces of those regular or irregular three-dimensional shapes may have a smooth or rough contour, e.g., the surfaces may be flat, curved, or undulating (e.g., smoothly or with discontinuous slopes), as may arise from a given manufacturing process. Nonetheless, nominal dimensions of each segment can be selected in a manner described above to achieve a desired overall tuning for the segmented channel.

VII. Computing Environments

Figure 27:
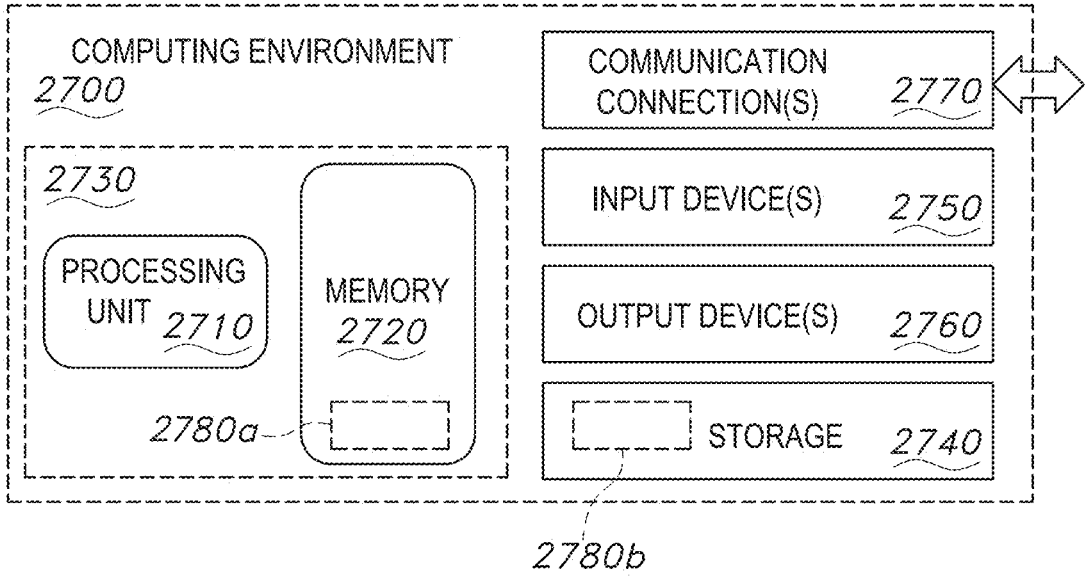
FIG. 27 shows a block diagram of a computing environment suitable to implement disclosed technologies.

FIG. 27 illustrates a generalized example of a suitable computing environment 2700 in which described technologies can be implemented. The computing environment 2700 is not intended to suggest any limitation as to scope of use or functionality of the technologies disclosed herein, as each technology may be implemented in diverse general-purpose or special-purpose computing environments. For example, each disclosed technology may be implemented with other computer system configurations, including wearable and/or handheld devices (e.g., a mobile-communications device, and more particularly but not exclusively, IPHONE®/IPAD®/HomePod™/AIRPODS® devices, available from Apple Inc. of Cupertino, Calif.), multiprocessor systems, microprocessor-based or programmable consumer electronics, embedded platforms, network computers, minicomputers, mainframe computers, smartphones, tablet computers, data centers, audio appliances, and the like. Each disclosed technology may also be practiced in distributed computing environments where tasks are performed by remote processing devices that are linked through a communications connection or network. In a distributed computing environment, program modules may be located in both local and remote memory storage devices.

The computing environment 2700 includes at least one central processing unit 2710 and a memory 2720. In FIG. 27, this most basic configuration 2730 is included within a dashed line. The central processing unit 2710 executes computer-executable instructions and may be a real or a virtual processor. In a multi-processing system, or in a multi-core central processing unit, multiple processing units execute computer-executable instructions (e.g., threads) to increase processing speed and as such, multiple processors can run simultaneously, despite the processing unit 2710 being represented by a single functional block. A processing unit can include an application specific integrated circuit (ASIC), a general purpose microprocessor, a field-programmable gate array (FPGA), a digital signal controller, or a set of hardware logic structures arranged to process instructions.

The memory 2720 may be volatile memory (e.g., registers, cache, RAM), non-volatile memory (e.g., ROM, EEPROM, flash memory, etc.), or some combination of the two. The memory 2720 stores software 2780*a* that can, for example, implement one or more of the technologies described herein, when executed by a processor.

A computing environment may have additional features. For example, the computing environment 2700 includes storage 2740, one or more input devices 2750, one or more output devices 2760, and one or more communication connections 2770. An interconnection mechanism (not shown) such as a bus, a controller, or a network, interconnects the components of the computing environment 2700. Typically, operating system software (not shown) provides an operating environment for other software executing in the computing environment 2700, and coordinates activities of the components of the computing environment 2700.

The store 2740 may be removable or non-removable, and can include selected forms of machine-readable media. In general machine-readable media includes magnetic disks, magnetic tapes or cassettes, non-volatile solid-state memory, CD-ROMs, CD-RWs, DVDs, magnetic tape, optical data storage devices, and carrier waves, or any other machine-readable medium which can be used to store information and which can be accessed within the computing environment 2700. The storage 2740 can store instructions for the software 2780*b*, which can implement technologies described herein.

The store 2740 can also be distributed over a network so that software instructions are stored and executed in a distributed fashion. In other aspects, some of these operations might be performed by specific hardware components that contain hardwired logic. Those operations might alternatively be performed by any combination of programmed data processing components and fixed hardwired circuit components.

The input device(s) 2750 may be any one or more of the following: a touch input device, such as a keyboard, keypad, mouse, pen, touchscreen, touch pad, or trackball; a voice input device, such as a microphone transducer, speech-recognition software and processors; a scanning device; or another device, that provides input to the computing environment 2700. For audio, the input device(s) 2750 may include a microphone or other transducer (e.g., a sound card or similar device that accepts audio input in analog or digital form), or a computer-readable media reader that provides audio samples to the computing environment 2700.

The output device(s) 2760 may be any one or more of a display, printer, loudspeaker transducer, DVD-writer, or another device that provides output from the computing environment 2700.

The communication connection(s) 2770 enable communication over or through a communication medium (e.g., a connecting network) to another computing entity. A communication connection can include a transmitter and a receiver suitable for communicating over a local area network (LAN), a wide area network (WAN) connection, or both. LAN and WAN connections can be facilitated by a wired connection or a wireless connection. If a LAN or a WAN connection is wireless, the communication connection can include one or more antennas or antenna arrays. The communication medium conveys information such as computer-executable instructions, compressed graphics information, processed signal information (including processed audio signals), or other data in a modulated data signal. Examples of communication media for so-called wired connections include fiber-optic cables and copper wires. Communication media for wireless communications can include electromagnetic radiation within one or more selected frequency bands.

Machine-readable media are any available media that can be accessed within a computing environment 2700. By way of example, and not limitation, with the computing environment 2700, machine-readable media include memory 2720, storage 2740, communication media (not shown), and combinations of any of the above. Tangible machine-readable (or computer-readable) media exclude transitory signals.

As explained above, some disclosed principles can be embodied in a tangible, non-transitory machine-readable medium (such as microelectronic memory) having stored thereon instructions. The instructions can program one or more data processing components (generically referred to here as a "processor") to perform a processing operations described above, including estimating, computing, calculating, measuring, adjusting, sensing, measuring, filtering, addition, subtraction, inversion, comparisons, and decision making (such as by the control unit 52). In other aspects, some of these operations (of a machine process) might be performed by specific electronic hardware components that contain hardwired logic (e.g., dedicated digital filter blocks). Those operations might alternatively be performed by any combination of programmed data processing components and fixed hardwired circuit components.

VII. Other Embodiments and Examples

The previous description is provided to enable a person skilled in the art to make or use the disclosed principles. Arrangements other than those described above in detail are contemplated based on the principles disclosed herein, together with any attendant changes in configurations of the respective apparatus or changes in order of method acts described herein, without departing from the spirit or scope of this disclosure. Various modifications to the examples described herein will be readily apparent to those skilled in the art.

For example, an electronic device can have an acoustic transducer element having an acoustic diaphragm. The diaphragm can have opposed first and second major surfaces. A front volume can be positioned adjacent the first major surface of the diaphragm. A back volume can be positioned adjacent the second major surface of the diaphragm. A substrate can be coupled with the acoustic transducer element, and a segmented channel can define a barometric vent fluidly coupling the front volume with the back volume. The segmented channel can extend from a first end fluidly coupled with the front volume to a second end fluidly coupled with the back volume, and a portion of the segmented channel can extend through the substrate.

In an example, the barometric vent can be configured to equalize pressure between the front volume and the back volume.

The segmented channel can have, for example, a plurality of duct portions and a plurality of chamber portions. Each duct portion can extend from one of the chamber portions to an adjacent chamber portion, providing a contraction in cross-sectional area from each respective chamber portion into the corresponding duct portion and an expansion in cross-sectional area from the respective duct portion to the corresponding adjacent chamber portion.

The substrate can define an acoustic port opening to the front volume. In an example, the substrate is a first substrate, and the electro-acoustic device can have a second substrate. The first substrate can be mounted to the second substrate. The electro-acoustic device can also have an integrated circuit device mounted to the second substrate. The integrated circuit device and the acoustic transducer element can be electrically coupled with each other. The second substrate can have an electrical output connection coupled with the integrated circuit device. The electro-acoustic device can also include a recessed lid overlying the acoustic transducer element, the first substrate, and the integrated circuit device.

In another example, the substrate also defines the segmented channel. Further, the segmented channel can have a plurality of duct portions and a plurality of chamber portions. Each duct portion can extend from one of the chamber portions to an adjacent chamber portion, providing a contraction in cross-sectional area from each respective chamber portion into the corresponding duct portion and an expansion in cross-sectional area from the respective duct portion to the corresponding adjacent chamber portion.

In an example, a region of the segmented channel can open to the acoustic port. The substrate can have a plurality of juxtaposed layers and an aperture can extend through the plurality of layers to define the acoustic port. In another example, a region of the segmented channel opens to the front volume.

At least one of the layers can define a corresponding portion of the segmented channel having a duct portion and a corresponding chamber portion. The duct portion can have a cross-sectional area substantially smaller than a corresponding cross-sectional area of the chamber portion.

The segmented channel can have a plurality of comparatively narrow duct portions juxtaposed with a corresponding plurality of comparatively wider chamber portions. The segmented channel can define at least one convolution among the duct portions and the chamber portions.

The at least one layer can include a first layer and a second layer. Each respective portion of the segmented channel defined by the first layer and each respective portion of the segmented channel defined by the second layer can be fluidly coupled together, defining a convolution in the segmented channel. Such a substrate, in another example, can include an intermediate layer of material separating the first layer and the second layer from each other. The intermediate layer can define an aperture fluidly coupling the segment of the segmented channel defined by the first layer with the segment of the segmented channel defined by the second layer.

In another example, the substrate has a first layer and a second layer. The second layer can be positioned between the first layer and the acoustic diaphragm. The second layer can have a sacrificial insulator susceptible to etching and an etch-stop defining a boundary of a recess extending through the sacrificial insulator. The recess can define a corresponding portion of the segmented channel.

According to an example, the first end of the segmented channel can be positioned adjacent the acoustic port, the front volume, or both, and the second end of the segmented channel can be positioned adjacent the back volume.

The portion of the segmented channel that extends through the substrate can have a duct portion and a corresponding chamber portion. The duct portion can have a first end that opens to the front volume and a second end that opens to the corresponding chamber portion.

The acoustic transducer element can be mountably coupled with the substrate and can define an aperture aligned with the segmented channel. For example, the aperture can open to the back volume, fluidly coupling the front volume with the back volume.

In an example, the acoustic transducer element has a back plate and an insulator. The insulator can be positioned between the diaphragm and the backplate.

In another example, the acoustic transducer element has a first back plate and a corresponding first insulator positioned between the first back plate and the diaphragm. The acoustic transducer element can also have a second back plate and a corresponding second insulator positioned between the second back plate and the diaphragm. The diaphragm can be positioned between the first back plate and the second back plate.

In another example, the diaphragm is a first diaphragm. The acoustic transducer element can have a back plate and a first insulator positioned between the back plate and the first diaphragm. The acoustic transducer element can also have a second diaphragm, and a second insulator positioned between the second diaphragm and the back plate. The back plate can be positioned between the first diaphragm and the second diaphragm.

In yet another example, the diaphragm can have a piezoelectric actuator and a substrate defining an open port. The diaphragm can be mounted to the substrate and the piezoelectric actuator can extend over the open port.

According to other examples, an electronic device can include an acoustic transducer element having a movable diaphragm. The diaphragm can have opposed first and second major surfaces, and the acoustic transducer element can define an aperture positioned adjacent the movable diaphragm. A substrate can be coupled with the acoustic transducer element. The substrate can define an acoustic port open to the acoustic transducer element and a segmented passageway extending from a first end fluidly coupled with the acoustic port to a second end fluidly coupled with the aperture, defining a barometric vent coupling the acoustic port with the aperture.

For example, the substrate can have a plurality of juxtaposed layers and an opening can extend through the plurality of layers to define the acoustic port. The at least one layer can be a first layer, and the substrate can have a second layer. The first layer can define a corresponding first channel and the second layer can define a corresponding second channel. The first channel and the second channel can be fluidly coupled with each other, defining a convolution in the segmented passageway.

The segmented passageway can have a plurality of duct regions juxtaposed with a corresponding plurality of chamber regions. Each respective duct region can have a cross-sectional area substantially smaller than a corresponding cross-sectional area of an adjacent chamber region.

Directions and other relative references (e.g., up, down, top, bottom, left, right, rearward, forward, etc.) may be used to facilitate discussion of the drawings and principles herein, but are not intended to be limiting. For example, certain terms may be used such as "up," "down,", "upper," "lower," "horizontal," "vertical," "left," "right," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" or "or", as well as "and" and "or." Moreover, all patent and non-patent literature cited herein is hereby incorporated by reference in its entirety for all purposes.

And, those of ordinary skill in the art will appreciate that the exemplary embodiments disclosed herein can be adapted to various configurations and/or uses without departing from the disclosed principles. Applying the principles disclosed herein, it is possible to provide a wide variety of arrangements for high-aspect ratio, barometric vents to reduce leakage noise. For example, the principles described above in connection with any particular example can be combined with the principles described in connection with another example described herein. Thus, all structural and functional equivalents to the features and method acts of the various embodiments described throughout the disclosure that are known or later come to be known to those of ordinary skill in the art are intended to be encompassed by the principles described and the features and acts claimed herein. Accordingly, neither the claims nor this detailed description shall be construed in a limiting sense, and following a review of this disclosure, those of ordinary skill in the art will appreciate the wide variety of acoustic vents that can be devised using the various concepts described herein.

Moreover, nothing disclosed herein is intended to be dedicated to the public regardless of whether such disclosure is explicitly recited in the claims. No claim feature is to be construed under the provisions of 35 USC 112(f), unless the feature is expressly recited using the phrase "means for" or "step for".

The appended claims are not intended to be limited to the arrangements shown herein, but are to be accorded the full scope consistent with the language of the claims, wherein reference to a feature in the singular, such as by use of the article "a" or "an" is not intended to mean "one and only one" unless specifically so stated, but rather "one or more". Further, in view of the many possible embodiments to which the disclosed principles can be applied, we reserve the right to claim any and all combinations of features and technologies described herein as understood by a person of ordinary skill in the art, including the right to claim, for example, all that comes within the scope and spirit of the foregoing description, as well as the combinations recited, literally and equivalently, in any claims presented anytime throughout prosecution of this application or any application claiming benefit of or priority from this application, and more particularly but not exclusively in the claims appended hereto.

We claim:

1. An electro-acoustic device, comprising:

an acoustic transducer element having an acoustic diaphragm, wherein the diaphragm has opposed first and second major surfaces;

a front volume positioned adjacent the first major surface of the diaphragm;

a back volume positioned adjacent the second major surface of the diaphragm;

a substrate coupled with the acoustic transducer element and defining an opening that forms an acoustic port aligned with the acoustic diaphragm; and an elongated channel defining a barometric vent fluidly coupling the front volume with the back volume, wherein the elongated channel extends from a first end fluidly coupled with the front volume to a second end fluidly coupled with the back volume, and a portion of the elongated channel extends through the substrate, wherein the portion of the elongated channel that extends through the substrate includes a circumferential portion that extends predominantly circumferentially around the opening from a first radial position at the first end to a second radial position at the second end, the second radial position disposed radially outward of the first radial position with respect to the opening, wherein the circumferential portion comprises a first circumferential portion that extends circumferentially around the opening at a first substantially constant radial position, a second circumferential portion that extends circumferentially around the opening at a second substantially constant radial position that is radially outward of the first substantially constant radial position, and a step that extends outward in a predominantly radial direction between the first circumferential portion and the second circumferential portion.

2. The electro-acoustic device according to claim 1, wherein the barometric vent is configured to equalize pressure between the front volume and the back volume.

3. The electro-acoustic device according to claim 1, wherein the substrate defines an acoustic port opening to the front volume.

4. The electro-acoustic device according to claim 3, wherein the substrate is a first substrate and the electro-acoustic device further comprises:

a second substrate, the first substrate being mounted to the second substrate;

an integrated circuit device mounted to the second substrate and coupled with the acoustic transducer element, wherein the second substrate comprises an electrical output connection coupled with the integrated circuit device; and a recessed lid overlying the acoustic transducer element, the first substrate, and the integrated circuit device.

5. The electro-acoustic device according to claim 4, wherein the second substrate further defines the elongated channel.

6. The electro-acoustic device according to claim 3, wherein the substrate further defines the elongated channel.

7. The electro-acoustic device according to claim 6, wherein the elongated channel opens to the acoustic port.

8. The electro-acoustic device according to claim 6, wherein the elongated channel opens to the front volume.

9. The electro-acoustic device according to claim 3, wherein the substrate comprises a plurality of juxtaposed layers and an aperture extends through the plurality of layers to define the acoustic port.

10. The electro-acoustic device according to claim 9, wherein at least one of the layers defines a corresponding segment of a sinuous passage, wherein the sinuous passage fluidly couples the front volume with the back volume, defining the elongated channel.

11. The electro-acoustic device according to claim 10, wherein the sinuous passage comprises at least one convolution.

12. The electro-acoustic device according to claim 10, wherein the at least one of the layers comprises a first layer and a second layer, wherein the first layer defines a corresponding first segment of the sinuous passage and the second layer defines a corresponding second segment of the sinuous passage, and wherein the first segment of the sinuous passage and the second segment of the sinuous passage are fluidly coupled together, the first segment and the second segment defining a convolution in the sinuous passage.

13. The electro-acoustic device according to claim 3, wherein the substrate comprises a first layer and a second layer, wherein the second layer is positioned between the first layer and the acoustic diaphragm and comprises a sacrificial insulator susceptible to etching and an etch-stop defining a boundary of a recess extending through the sacrificial insulator, wherein the recess defines a corresponding portion of the elongated channel.

14. The electro-acoustic device according to claim 3, wherein the first end of the elongated channel is positioned adjacent the acoustic port, the front volume, or both, and the second end of the elongated channel is positioned adjacent the back volume.

15. The electro-acoustic device according to claim 1, wherein the portion of the channel that extends through the substrate defines a tortuous portion of the barometric vent, wherein the tortuous portion of the barometric vent opens to the front volume.

16. The electro-acoustic device according to claim 15, wherein the acoustic transducer element is mountably coupled with the substrate and defines an aperture aligned with the tortuous portion of the barometric vent, wherein the aperture opens to the back volume, fluidly coupling the front volume with the back volume.

17. The electro-acoustic device according to claim 1, wherein the acoustic transducer element further comprises a back plate and an insulator positioned between the diaphragm and the backplate.

18. An electronic device, comprising:

an acoustic transducer element having a movable diaphragm, wherein the diaphragm has opposed first and second major surfaces, wherein the acoustic transducer element defines an aperture positioned adjacent the movable diaphragm;

a substrate coupled with the acoustic transducer element, wherein the substrate defines an acoustic port open to the acoustic transducer element and an elongated passageway extending between a first end directly and fluidly coupled with the acoustic port and a second end directly and fluidly coupled with the aperture, the elongated passageway defining a barometric vent coupling the acoustic port with the aperture.

19. The electronic device according to claim 18, wherein the substrate comprises a plurality of juxtaposed layers and an opening extends through the plurality of layers to define the acoustic port.

20. The electronic device according to claim 19, wherein at least one of the layers defines a corresponding channel defining a segment of the passageway.

21. The electronic device according to claim 20, wherein the passageway comprises a tortuous passageway having at least one convolution.

22. The electronic device according to claim 20, wherein the at least one of the layers comprises a first layer and a second layer, wherein the first layer defines a corresponding first channel and the second layer defines a corresponding second channel, wherein the first channel and the second channel are fluidly coupled with each other, the first channel and the second channel defining a convolution in the elongated passageway.

23. The electronic device according to claim 19, wherein the plurality of juxtaposed layers comprises a first layer and a second layer, the second layer positioned between the first layer and the acoustic transducer element, the second layer comprising:

a sacrificial insulator susceptible to etching; and an etch-stop defining a boundary of a channel extending through the sacrificial insulator, wherein the channel defines a corresponding portion of the elongated passageway.

24. The electronic device according to claim 18, wherein the acoustic transducer element further comprises a back plate and an insulator positioned between the diaphragm and the backplate.

25. The electronic device according to claim 18, wherein the acoustic transducer element comprises a first back plate and a corresponding first insulator positioned between the first back plate and the diaphragm, a second back plate and a corresponding second insulator positioned between the second back plate and the diaphragm, wherein the diaphragm is positioned between the first back plate and the second back plate.

26. The electronic device according to claim 18, wherein the diaphragm is a first diaphragm and wherein the acoustic transducer element comprises a back plate, a first insulator positioned between the back plate and the first diaphragm, a second diaphragm, and a second insulator positioned between the second diaphragm and the back plate, wherein the back plate is positioned between the first diaphragm and the second diaphragm.

27. The electronic device according to claim 18, wherein the diaphragm comprises a piezoelectric actuator, wherein the diaphragm is mounted to the substrate and the piezoelectric actuator extends over the acoustic port.

28. An electronic device, comprising:

electro-acoustic device, comprising:

an acoustic transducer element having an acoustic diaphragm, wherein the diaphragm has opposed first and second major surfaces;

a front volume positioned adjacent the first major surface of the diaphragm;

a back volume positioned adjacent the second major surface of the diaphragm;

a substrate coupled with the acoustic transducer element and defining an opening that forms an acoustic port aligned with the acoustic diaphragm; and an elongated channel defining a barometric vent fluidly coupling the front volume with the back volume, wherein the elongated channel extends from a first end fluidly coupled with the front volume to a second end fluidly coupled with the back volume, and a portion of the elongated channel extends through the substrate, wherein the portion of the elongated channel that extends through the substrate includes a circumferential portion that extends predominantly circumferentially around the opening from a first radial position at the first end to a second radial position at the second end, the second radial position disposed radially outward of the first radial position with respect to the opening, wherein the circumferential portion comprises a first circumferential portion that extends circumferentially around the opening at a first substantially constant radial position, a second circumferential portion that extends circumferentially around the opening at a second substantially constant radial position that is radially outward of the first substantially constant radial position, and a step that extends outward in a predominantly radial direction between the first circumferential portion and the second circumferential portion.

* * * * *